US010635035B2

(12) United States Patent
Yabuki

(10) Patent No.: US 10,635,035 B2
(45) Date of Patent: Apr. 28, 2020

(54) FIXING DEVICE AND IMAGE FORMING APPARATUS

(71) Applicant: Konica Minolta, Inc., Tokyo (JP)

(72) Inventor: Shinichi Yabuki, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/252,790

(22) Filed: Jan. 21, 2019

(65) Prior Publication Data

US 2019/0235428 A1 Aug. 1, 2019

(30) Foreign Application Priority Data

Jan. 31, 2018 (JP) ..... 2018-014831

(51) Int. Cl.
*G03G 15/20* (2006.01)

(52) U.S. Cl.
CPC ..... *G03G 15/2064* (2013.01); *G03G 15/2028* (2013.01); *G03G 15/2053* (2013.01); *G03G 2215/2038* (2013.01)

(58) Field of Classification Search
CPC ..... G03G 15/0105; G03G 15/20; G03G 15/0889; G03G 15/0891; G03G 15/2032; G03G 15/2039; G03G 15/2064; G03G 2215/20; G03G 2215/2003; G03G 2215/2016; G03G 2215/2035
USPC ..... 399/122, 320, 328–334; 219/216, 619
See application file for complete search history.

(56) References Cited

U.S. PATENT DOCUMENTS 8,509,668 B2 * 8/2013 Takemura ..... G03G 15/2039 399/328
9,104,145 B2 * 8/2015 Okabayashi ..... G03G 15/2053
9,116,494 B2 * 8/2015 Tokuda ..... G03G 15/6576

FOREIGN PATENT DOCUMENTS

JP 2012103609 A 5/2012

* cited by examiner

*Primary Examiner* — Hoan H Tran
(74) *Attorney, Agent, or Firm* — Lucas & Mercanti, LLP

(57) ABSTRACT

A fixing device includes a pressure roller and a pressure pad that form a nip portion, and a nip member disposed opposite to the pressure roller as viewed from the pressure pad. The pressure pad is formed of an elongated flat-plate member and includes a first main surface located on a pressure roller side and a second main surface located on a nip member side. The nip member includes a receiving portion abutting against the pressure pad in a pressed state. A portion of the second main surface which corresponds to a passage region of the recording material provided at the nip portion is provided with a plurality of recesses, and the entire perimeter of each of the plurality of recesses is surrounded by projections. Top surfaces of the projections are in close contact with the receiving portion in the pressed state.

34 Claims, 26 Drawing Sheets

FIXING DEVICE AND IMAGE FORMING APPARATUS

Japanese Patent Application No. 2018-014831 filed on Jan. 31, 2018, including description, claims, drawings, and abstract the entire disclosure is incorporated herein by reference in its entirety.

BACKGROUND

Technological Field

The present disclosure relates to a fixing device that fixes a toner image formed on a recording material such as a sheet onto the recording material. The present disclosure also relates to an image forming apparatus such as a copying machine, printer, or facsimile machine including the fixing device installed in an image forming device that forms an image based on electrophotography. The image forming apparatus may be of any type, for example, color or monochrome one.

An electrophotographic image forming apparatus commonly includes a thermal fixing device. The thermal fixing device commonly has a pressing rotator and a heating rotator, and nips a recording material, which has a toner image formed thereon, between the pressing rotator and the heating rotator, thereby fixing the toner image onto the recording material.

For example, Japanese Laid-Open Patent Publication No. 2012-103609 discloses a fixing device including a pressure roller serving as a pressing rotator and an endless fixing belt serving as a heating rotator. The fixing device includes a pad-shaped nip forming member disposed to face the pressing rotator so as to nip the fixing belt between the pressing rotator and the nip forming member, and is configured to press the fixing belt toward the nip forming member by the pressure roller during fixing operation.

During fixing operation, a nip portion is accordingly formed between the pressure roller and the nip forming member (more strictly, between the pressure roller and the fixing belt disposed between the pressure roller and the nip forming member). This causes the pressure roller to be rotationally driven with the fixing belt being pressed toward the nip forming member by the pressure roller, driving the fixing belt to rotate following the rotation of the pressure roller.

Consequently, as the recording material supplied to the nip portion passes through the nip portion, heat and pressure are applied to the toner image formed on the recording material at the nip portion, thus fixing the toner image onto the recording material.

In order to improve the quality of an image formed on a recording material by the image forming apparatus, the pressure applied to the recording material at the nip portion of the fixing device needs to be controlled properly. Since the quality of the image formed on the recording material naturally becomes uneven especially if uneven fixing occurs during fixing operation, it is important to reduce occurrence of uneven fixing to the greatest possible extent.

In this respect, the fixing device disclosed in the above publication includes a plurality of protrusions and a plurality of elongated protrusions. The plurality of protrusions are provided in the form of a sequence of points in the width direction of the fixing belt on the rear surface of the nip forming member (i.e., the main surface opposite to the pressure roller as viewed from the nip forming member). The plurality of elongated protrusions are provided on the surface of a holding member on the nip forming member side, which is disposed on the rear surface side of the nip forming member and is made of metal material, to be arranged in the width direction of the fixing belt. The fixing device is configured such that the plurality of protrusions and the plurality of elongated protrusions abut against each other during fixing operation.

In such a configuration, however, a locally high pressure is applied to the recording material at a position corresponding to each of the plurality of protrusions provided in the nip forming member, due to an excessively high pressing force of the pressure roller.

An object of the present disclosure is to provide a fixing device capable of suppressing occurrence of an uneven image formed on a recording material and an image forming apparatus including the fixing device.

SUMMARY

To achieve at least one of the abovementioned objects, according to a first aspect of the present invention, a fixing device reflecting one aspect of the present invention heats and pressurizes a toner image, which is formed on a recording material, at a nip portion provided in a transport path for the recording material to fix the toner image onto the recording material, and includes a heating source, a pressure roller, a pressure pad, and a nip member. The heating source heats the toner image formed on the recording material. The pressure roller and the pressure pad are disposed to face each other with the transport path therebetween so as to form the nip portion. The nip member is disposed opposite to the pressure roller as viewed from the pressure pad and nips the pressure pad between the pressure roller and the nip member in a pressed state in which the pressure pad is pressed by the pressure roller. The pressure pad is formed of an elongated flat-plate member extending in a width direction parallel to an axial direction of the pressure roller, and includes a first main surface located on a pressure roller side and a second main surface located on a nip member side. The nip member includes a receiving portion abutting against the pressure pad in the pressed state. A portion of the second main surface which corresponds to a passage region for the recording material provided at the nip portion is provided with a plurality of recesses, and an entire perimeter of each of the plurality of recesses is surrounded by projections in a direction orthogonal to a pressing direction of the pressure roller. Top surfaces of the projections are in close contact with the receiving portion in the pressed state.

To achieve at least one of the abovementioned objects, according to a second aspect of the present invention, a fixing device reflecting one aspect of the present invention heats and pressurizes a toner image, which is formed on a recording material, at a nip portion provided in a transport path for the recording material to fix the toner image onto the recording material, and includes a heating source, a pressure roller, a pressure pad, and a nip member. The heating source heats a toner image formed on the recording material. The pressure roller and the pressure pad are disposed to face each other with the transport path therebetween so as to form the nip portion. The nip member is disposed opposite to the pressure roller as viewed from the pressure pad and nips the pressure pad between the pressure roller and the nip member in a pressed state in which the pressure pad is pressed by the pressure roller. The pressure pad is formed of an elongated flat-plate member extending in a width direction parallel to an axial direction of the pressure roller and includes a first main surface located on a pressure roller side and a second main surface located on a nip member side. The nip member includes a receiving portion abutting against the pressure pad in the pressed state. A portion of the second main surface which corresponds to a passage region for the recording material provided at the nip portion is provided with a plurality of projections each having an elongated projection shape and being sandwiched between recesses in a direction orthogonal to a pressing direction of the pressure roller. Each of top surfaces of the plurality of projections is in close contact with the receiving portion in the pressed state.

To achieve at least one of the abovementioned objects, according to an aspect of the present invention, an image forming apparatus reflecting one aspect of the present invention includes a fixing device according to the first or second aspect for image formation.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

The embodiments below will describe a so-called tandem-type color printer based on electrophotography and a fixing device included in the color printer by way of example, as an image forming apparatus and a fixing device included in the image forming apparatus to which the present invention is applied. In the embodiments below, the same components and constitutional elements are denoted by the same references, description of which will not be repeated.

Embodiment 1

Figure 1:
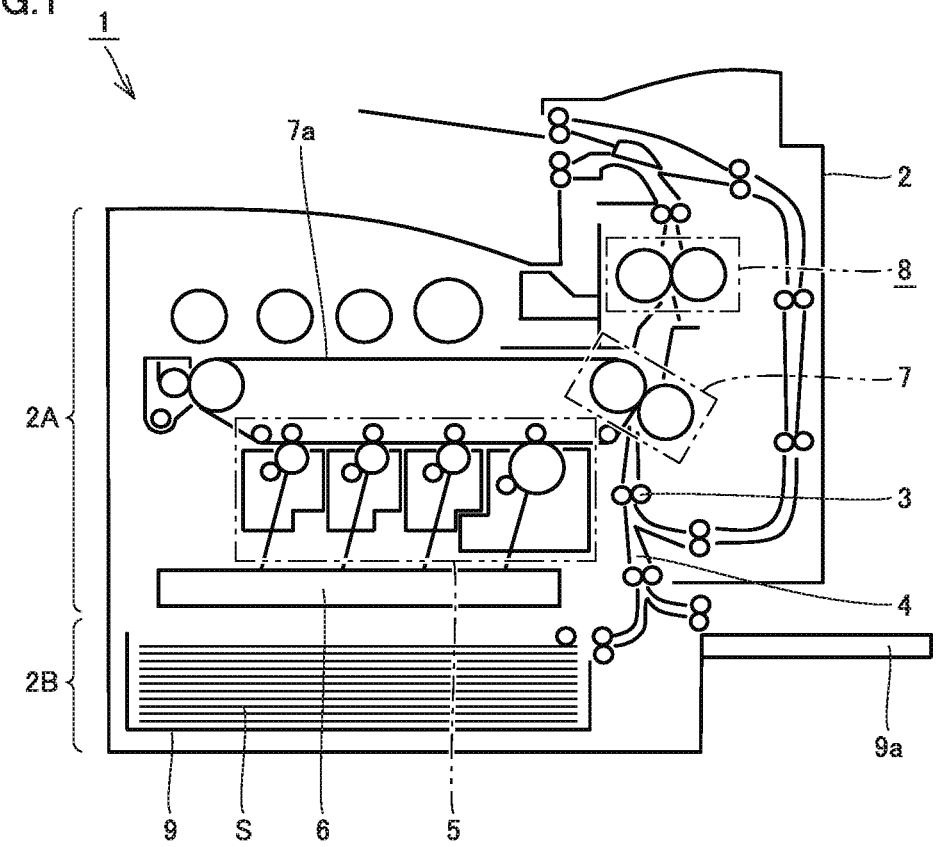
FIG. 1 is a schematic view of an image forming apparatus according to Embodiment 1.

FIG. 1 is a schematic view of an image forming apparatus according to Embodiment 1. A general configuration and operation of an image forming apparatus 1 according to the present embodiment will now be described with reference to FIG. 1.

As shown in FIG. 1, image forming apparatus 1 mainly includes an apparatus body 2 and a sheet feeding unit 9. Apparatus body 2 includes an image forming device 2A that is a part for forming an image on a sheet S serving as a recording material, and a sheet feeding device 2B that is a part for supplying sheet S to image forming device 2A. Sheet feeding unit 9 accommodates sheets S to be supplied to image forming device 2A and is provided detachably in sheet feeding device 2B.

Disposed inside image forming apparatus 1 are a plurality of rollers 3. Rollers 3 allow a transport path 4, through which sheet S is transported in a predetermined direction, to be formed across image forming device 2A and sheet feeding device 2B described above. Also, as shown in FIG. 1, apparatus body 2 may be separately provided with a manual feed tray 9*a* for supplying sheet S to image forming device 2A.

Image forming device 2A mainly includes an image forming unit 5, an exposing unit 6, an intermediate transfer belt 7*a*, a transfer device 7, and a fixing device 8 according to the present embodiment, which will be described below. Image forming unit 5 can form toner images of, for example, yellow (Y), magenta (M), cyan (C), and black (K) colors. Exposing unit 6 exposes a photoconductor included in image forming unit 5. Intermediate transfer belt 7*a* is laid across image forming unit 5. Transfer device 7 is provided on transport path 4 and also on a lane of intermediate transfer belt 7*a*. Fixing device 8 is provided on transport path 4 which is downstream of transfer device 7.

Image forming unit 5 forms a toner image of yellow (Y), magenta (M), cyan (C), and black (K) colors or a toner image of black (K) alone on the surface of the photoconductor through exposure by exposing unit 6 and transfers the toner image onto intermediate transfer belt 7*a* (i.e., primary transfer). A color toner image or monochrome toner image is accordingly formed on intermediate transfer belt 7*a*.

Intermediate transfer belt 7*a* conveys the color toner image or monochrome toner image formed on its surface to transfer device 7, and the conveyed image is pressed by transfer device 7 together with sheet S transported from sheet feeding device 2B to transfer device 7. The color toner image or monochrome toner image formed on the surface of intermediate transfer belt 7*a* is accordingly transferred to sheet S (i.e., secondary transfer).

Sheet S with the color toner image or monochrome toner image transferred thereto is subsequently pressurized and heated by fixing device 8. The color image or monochrome image is accordingly formed on sheet S, and subsequently, sheet S with the color image or monochrome image formed thereon is discharged from apparatus body 2.

Figure 2:
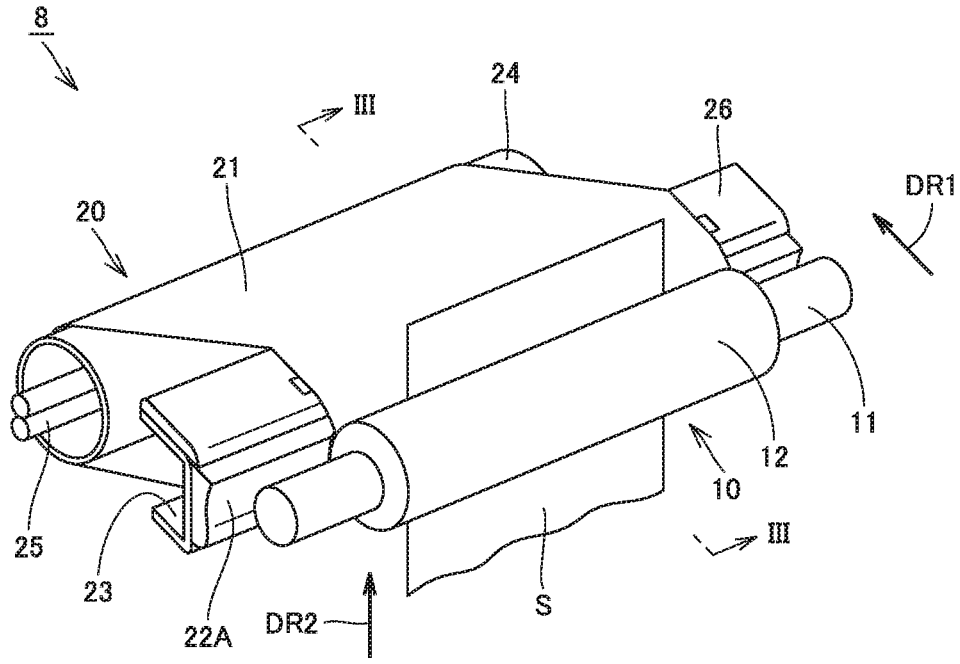
FIG. 2 is a schematic perspective view of a fixing device according to Embodiment 1.
Figure 3:
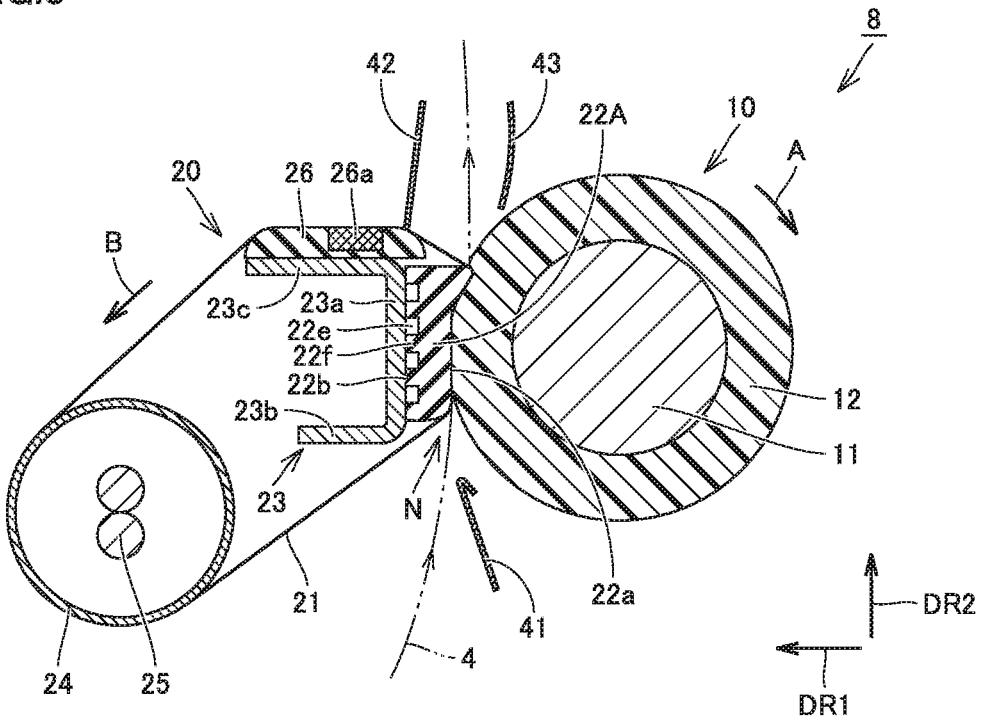
FIG. 3 is a schematic sectional view of the fixing device shown in FIG. 2.
Figure 4:
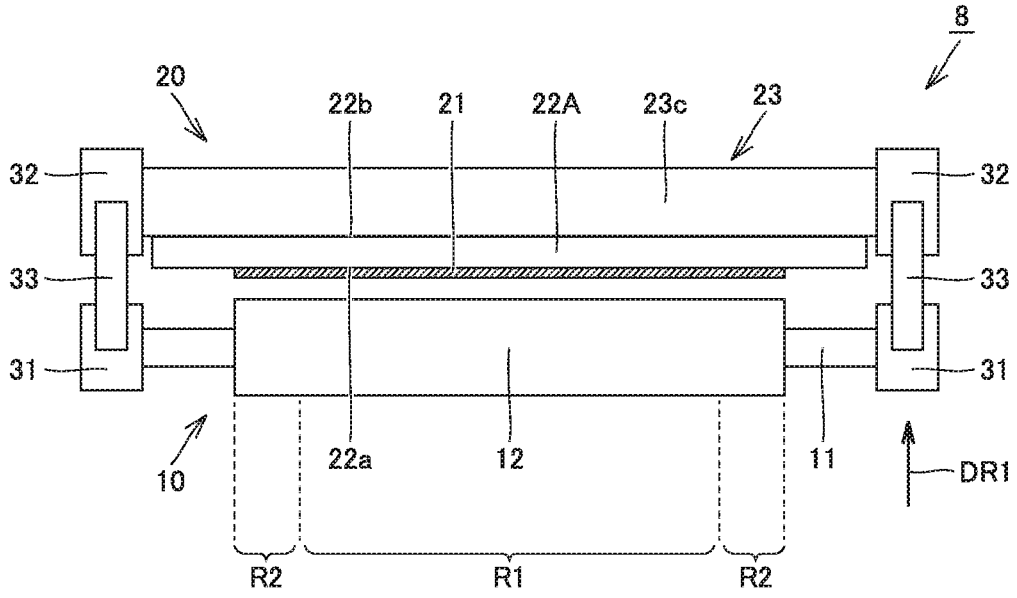
FIG. 4 is a schematic plan view of the fixing device shown in FIG. 2.

FIG. 2 is a schematic perspective view of the fixing device according to the present embodiment. FIG. 3 is a schematic sectional view of the fixing device shown in FIG. 2, which is taken along line III-III in FIG. 2, and FIG. 4 is a schematic plan view of the fixing device shown in FIG. 2. The configuration and operation of fixing device 8 according to the present embodiment will now be described with reference to FIGS. 2 to 4. FIGS. 2 and 3 show fixing device 8 during fixing operation, and FIG. 4 shows fixing device 8*a* during standby (during non-fixing operation).

As shown in FIGS. 2 to 4, fixing device 8 includes a pressure roller 10 serving as a pressing rotator, a fixing belt unit 20 including a fixing belt 21 serving as a heating rotator, a first chassis 31 (see FIG. 4), a second chassis 32 (see FIG. 4), a pair of biasing members 33 (see FIG. 4), and various guides 41 to 43 (see FIG. 3) for guiding the transportation of sheet S.

Pressure roller 10 includes a metal core 11 made of, for example, aluminum alloy or iron, and an elastic rubber layer 12 provided to cover core 11 and made of, for example, silicone rubber or fluororubber. Pressure roller 10 may further include a release layer provided to cover elastic layer 12 and made of, for example, fluorine-based resin.

Core 11 may be of various shapes such as a solid cylindrical shape and a hollow columnar shape and has an outside diameter of, for example, 20 mm or more and 100 mm or less, which is not particularly limited. Although the thickness of elastic layer 12 and the thickness of the release layer are also not particularly limited, the thickness of elastic layer 12 is, for example, 1 mm or more and 20 mm or less, and the thickness of the release layer is, for example, 5 μm or more and 100 μm or less.

Pressure roller 10 is disposed to face the outer circumferential surface of fixing belt 21 and has opposite axial ends pivotally supported in a rotatable manner by a shaft support provided in first chassis 31. Pressure roller 10 is rotationally driven by, for example, a drive source (not shown) such as a motor. Pressure roller 10 is configured to be elastically biased toward fixing belt unit 20 by the pair of biasing members 33.

Fixing belt unit 20 mainly includes a pressure pad 22A, a nip member 23, a heating roller 24, a heating source 25, and an auxiliary pad 26 in addition to fixing belt 21 described above. FIG. 4 does not show part of fixing belt 21, heating roller 24, heating source 25, and auxiliary pad 26.

Fixing belt 21 is endless and is formed of, for example, a plurality of layers in consideration of heat resistance, strength, and surface smoothness. Specifically, fixing belt 21 includes a base layer made of, for example, polyimide resin, stainless alloy, or electroformed nickel, an elastic rubber layer made of, for example, silicone rubber or flurorubber, and a release layer made of, for example, fluorine-based resin. These layers are disposed in order of the base layer, the elastic layer, and the release layer from inside to outside of fixing belt 21.

Although the outside diameter (i.e., outer circumferential length) of fixing belt 21 is not particularly limited, it is, for example, 10 mm or more and 100 mm or less. Although the thickness of the base layer, the thickness of the elastic layer, and the thickness of the release layer are not particularly limited, the thickness of the base layer is, for example, 5 μm or more and 100 μm or less, the thickness of the elastic layer is, for example, 10 μm or more and 300 μm or less, and the thickness of the release layer is, for example, 5 μm or more and 100 μm or less.

Pressure pad 22A is formed of an elongated-plate member extending in the width direction of fixing belt 21 (i.e., the axial direction of pressure roller 10), and is mostly disposed in the space inside fixing belt 21. Pressure pad 22A accordingly faces the inner circumferential surface of fixing belt 21 to face pressure roller 10 with fixing belt 21 therebetween. Pressure pad 22A includes a first main surface 22*a* located on the pressure roller 10 side and a second main surface 22*b* opposite to pressure roller 10 (i.e., on the nip member 23 side).

Pressure pad 22A is formed of a resin member made of, for example, polyphenylene sulfide resin, polyimide resin, or liquid crystalline polymer resin, or a metal member made of, for example, aluminum alloy or iron. Pressure pad 22A may be formed of a composite part of any of the members described above and a rubber member made of, for example, silicone rubber or fluororubber. A detailed configuration of pressure pad 22A will be described below.

Nip member 23 is formed of an elongated-plate member extending in the with direction of fixing belt 21, and is mostly disposed in the space inside fixing belt 21 so as to be located opposite to pressure roller 10 as viewed from pressure pad 22A. Nip member 23 supports pressure pad 22A and also reinforces pressure pad 22A.

Nip member 23 has a generally C-shaped cross-section including a flat-plate receiving portion 23*a* facing second main surface 22*b* of pressure pad 22A, and a pair of flat-shaped upstanding wall portions 23*b* and 23*c* provided upright from receiving portion 23*a* opposite to pressure roller 10. Of the pair of upstanding wall portions 23*b* and 23*c*, upstanding wall portion 23*b* is provided upright from the end of receiving portion 23*a* which corresponds to an upstream position in a direction of transport DR2 of sheet S, which will be described below, and upstanding wall portion 23*c* is located upright from the end of receiving portion 23*a* which corresponds to a downstream position in direction of transport DR2 of sheet S.

Nip member 23 is formed of a metal member of, for example, electrolytic zinc-coated steel sheet (SECC). Nip member 23 is fixed to second chassis 32 by the opposite ends thereof being supported by second chassis 32. Pressure pad 22A is assembled while being lightly supported by nip member 23, as a result of, for example, a hook-shaped locking part (not shown) provided around pressure pad 22A being locked to, for example, the circumferential edge of receiving portion 23*a* of nip member 23.

Heating roller 24 is formed of a cylindrical member extending in the width direction of fixing belt 21, and is mostly disposed in the space inside fixing belt 21 so as to be located opposite to pressure roller 10 as viewed from nip member 23. This causes the outer circumferential surface of heating roller 24 to face the inner circumferential surface of fixing belt 21. Heating roller 24 transfers the heat generated in heating source 25 to fixing belt 21. The opposite axial ends of heating roller 24 are pivotally supported in a rotatable manner by a shaft support (not shown).

Heating roller 24 is formed of a hollow cylindrical metal member made of, for example, aluminum alloy. Although the outside diameter of heating roller 24 is not particularly limited, it is, for example, 10 mm or more and 100 mm or less. Heating roller 24 preferably has an inner circumferential surface covered with a black layer for efficient heat transfer, and an outer circumferential surface thereof may be covered with a protective layer made of, for example, fluorine-based resin.

Heating source 25 includes a long heater and a short heater, which are a pair of rod-shaped heaters extending parallel to the width direction of fixing belt 21, and are disposed in the space inside heating roller 24. Heating source 25 heats fixing belt 21 via heating roller 24 and has opposite axial ends held by a holding member (not shown). The long heater and the short heater are each formed of a halogen heater.

The long heater has a heat generating portion in a region corresponding to a generally entire region in the direction of fixing belt 21, and heats fixing belt 21 via heating roller 24 mainly by the radiant heat generated by the heat generating portion. The axial length of the heat generating portion corresponds to the width of a sheet having the greatest width among sheets of various sizes supplied to image forming apparatus 1. The axial length of the heat generating portion of the long heater generally corresponds to the width of a sheet passing region R1 (see FIG. 4) serving as a passing region for sheet S that passes through a nip portion N, which will be described below.

The short heater has a heat generating portion only in the region corresponding to the central portion in the width direction of fixing belt 21, and heats heat fixing belt 21 via heating roller 24 mainly by the radiant heat generated by the heat generating portion. The axial length of the heat generating portion corresponds to the width of a sheet having the smallest width among sheets of various sizes which are supplied to image forming apparatus 1.

Heating source 25 may be, for example, a heating source based on electromagnetic induction heating (IH) in addition to the halogen heater described above. Further, heating source 25 may be a heating source obtained by forming heating roller 24 or fixing belt 21 using a heating resistor.

Auxiliary pad 26 is formed of an elongated-plate member extending in the width direction of fixing belt 21 and is fixed onto the outer surface of upstanding wall portion 23*c* provided in nip member 23 so as to be mostly disposed in the space inside fixing belt 21. Auxiliary pad 26 is a guide for guiding fixing belt 21 and is provided to apply a lubricant to the inner circumferential surface of fixing belt 21.

More specifically, auxiliary pad 26 is provided at a position downstream of nip portion N described below in the direction of rotation of fixing belt 21, and has a lubricant supply portion 26*a* serving as an application portion. Lubricant supply portion 26*a* is formed of, for example, felt impregnated with a lubricant. Abutment of the inner circumferential surface of fixing belt 21 against lubricant supply portion 26*a* supplies the lubricant to the inner circumferential surface of fixing belt 21. This improves the slidability between fixing belt 21 and pressure pad 22A.

First chassis 31 pivotally supporting pressure roller 10 in a rotatable manner and second chassis 32 supporting pressure pad 22A via nip member 23 are connected to each other by the pair of biasing members 33 formed of, for example, coil springs. Consequently, with first chassis 31 and second chassis 32 being biased to close to each other by the biasing force of the pair of biasing members 33, fixing belt 21 is pressed against pressure pad 22A by pressure roller 10, resulting in a pressed state in which pressure pad 22A is pressed by pressure roller 10.

Fixing belt 21 is laid across pressure pad 22A, heating roller 24, and auxiliary pad 26 described above. This causes fixing belt 21 to rotate in a manner of sliding on first main surface 22*a* of pressure pad 22A. Through this rotation, the portion of fixing belt 21 which is in contact with heating roller 24 is heated by heating source 25, and subsequently, the relevant portion of fixing belt 21 moves to nip portion N described below, so that a toner image formed on sheet S supplied to nip portion N is heated by the relevant portion of fixing belt 21.

As shown in FIG. 3, in fixing device 8 according to the present embodiment, pressure roller 10 is rotationally driven in a direction of an arrow A shown in FIG. 3 by the driving source (not shown) with pressure roller 10 being biased toward fixing belt unit 20 by the pair of biasing members 33, as described above. This causes fixing belt 21 to rotate in a direction of an arrow B shown in FIG. 3 following the rotation of pressure roller 10 so as to slide on pressure pad 22A.

Consequently, nip portion N to which sheet S is transported is formed between pressure roller 10 and pressure pad 22A (more strictly, between pressure roller 10 and the outer circumferential surface of fixing belt 21). In other words, pressure roller 10 and fixing belt unit 20 are disposed to nip transport path 4 therebetween such that nip portion N formed therebetween is located on transport path 4 for the sheet.

Herein, at the opposite ends of pressure roller 10 other than the portion corresponding to sheet passing region R1 described above (the opposite ends are portions of nip portion N which correspond to a pair of outer regions R2 (see FIG. 4) located on the opposite outer sides of sheet passing region R1), exposing elastic layer 12 without providing the release layer described above can increase the frictional resistance to fixing belt 21 at the relevant portion. This causes fixing belt 21 to rotate more efficiently following the rotation of pressure roller 10.

Additionally or alternatively, at the opposite ends of fixing belt 21 other than the portion corresponding to sheet passing region R1 described above (the opposite ends are portions of nip portion N which correspond to the pair of outer regions R2 (see FIG. 4) located at the opposite outer sides of sheet passing region R1), exposing the elastic layer without providing the release layer described above can increase the frictional resistance to pressure roller 10 at the relevant portion. This causes fixing belt 21 to rotate more efficiently following the rotation of pressure roller 10.

In the pressed state in which pressure pad 22A is pressurized by pressure roller 10, the direction in which pressure roller 10 and fixing belt unit 20 are arranged corresponds to a pressing direction DR1 of pressure roller 10, and the direction orthogonal to pressing direction DR1 and orthogonal to the axial direction of pressure roller 10 (i.e., the width direction of fixing belt 21) corresponds to direction of transport DR2 of sheet S.

At a position that is located on transport path 4 and is upstream of nip portion N in direction of transport DR2 of sheet S (i.e., a downstream position in FIG. 3), an entrance guide 41 is provided. Entrance guide 41 is a guide for causing sheet S transported on transport path 4 to be reliably fed to nip portion N.

At a position that is located on transport path 4 and is downstream of nip portion N in direction of transport DR2 of sheet S (i.e., an upstream position in FIG. 3), a separation guide 42 and an exit guide 43 are provided. Separation guide 42 is a guide for separating sheet S in close contact with fixing belt 21 from fixing belt 21 when sheet S is ejected from nip portion N, and exit guide 43 is a guide for reliably returning sheet S separated from fixing belt 21 by separation guide 42 onto transport path 4.

In fixing device 8 according to the present embodiment with the above configuration, heat and pressure are applied to a toner image formed on sheet S at nip portion N during fixing operation (i.e., in the pressed state described above), causing the toner image to be fixed onto sheet S.

Figure 5A:
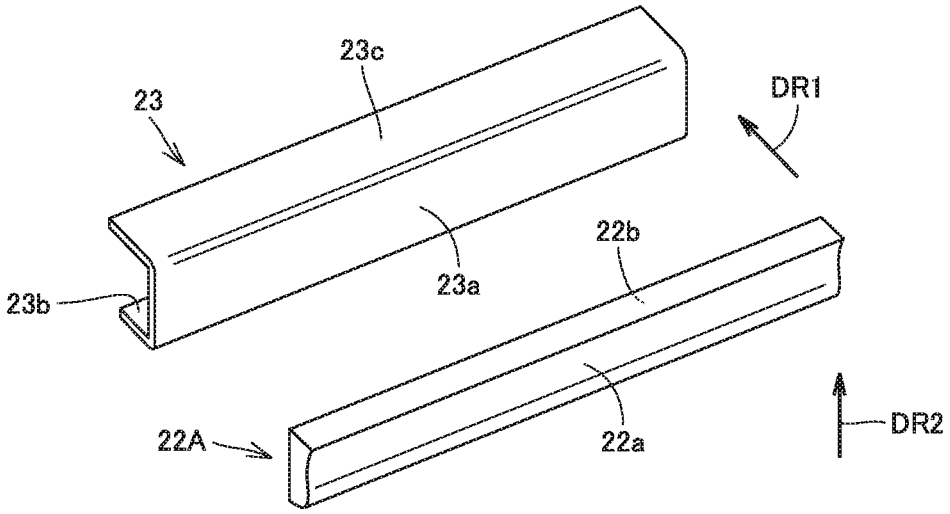
FIGS. 5A and 5B are schematic views showing the shapes of a pressure pad and a nip member of the fixing device shown in FIG. 2.
Figure 5B:
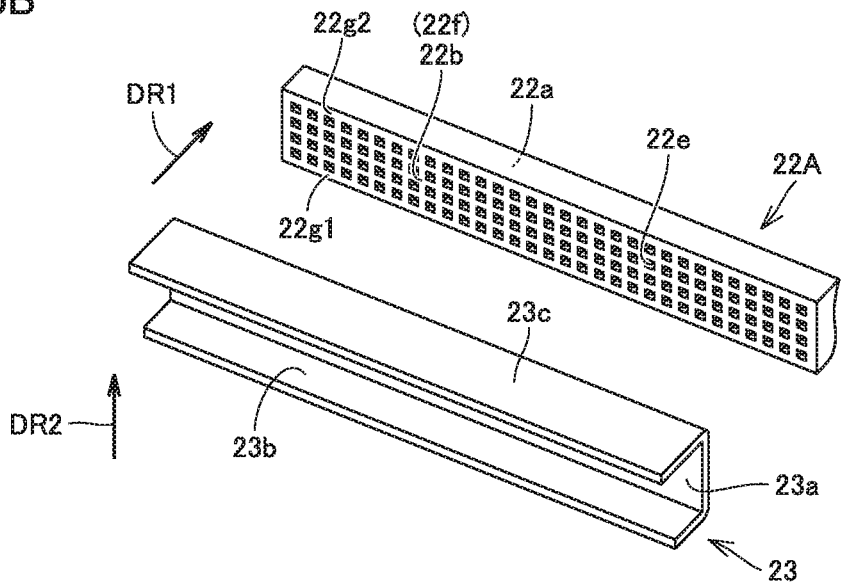
Figure 6B:
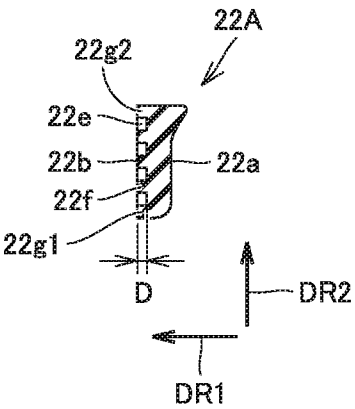
FIGS. 6B and 6C are sectional views of the pressure pad of the fixing device shown in FIG. 2.
Figure 6A:
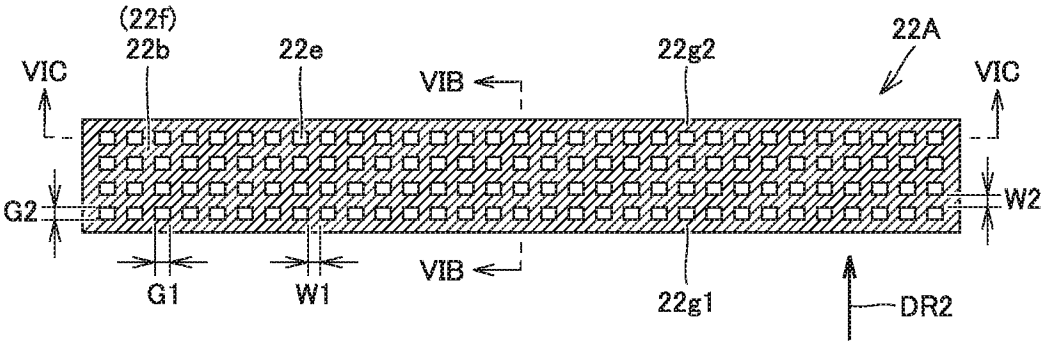
FIG. 6A is a rear view of the pressure pad of the fixing device shown in FIG. 2.
Figure 6C:
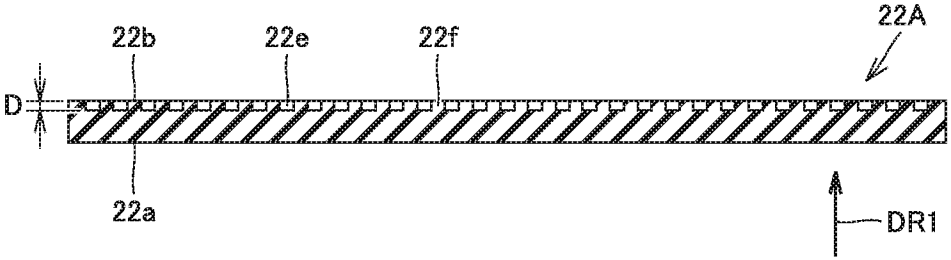

FIGS. 5A and 5B are schematic views showing the shapes of the pressure pad and the nip member of the fixing device shown in FIG. 2. FIG. 6A is a rear view of the pressure pad of the fixing device shown in FIG. 2, and FIGS. 6B and 6C are sectional views of the pressure pad of the fixing device shown in FIG. 2. A detailed structure of pressure pad 22A included in fixing device 8 according to the present embodiment will now be described with reference to FIGS. 5A, 5B, and 6A to 6C.

FIG. 5A shows pressure pad 22A and nip member 23 as viewed from the pressure roller 10 side, and FIG. 5B shows pressure pad 22A and nip member 23 as viewed from the heating roller 24 side. FIGS. 6B and 6C show cross-sections taken along line VIB-VIB and line VIC-VIC shown in FIG. 6A, respectively. Although FIG. 6A is a rear view of pressure pad 22A viewed from the nip member 23 side, for easy understanding, a portion defining second main surface 22*b* of pressure pad 22A (i.e., the top surfaces of projections 22*f*, which will be described below) is shaded in FIG. 6A (of the figures of the present application, the figures corresponding to the rear views of the pressure pad are processed as in FIG. 6A).

As shown in FIGS. 5A and 5B, in fixing device 8 according to the present embodiment, the surface of receiving portion 23*a* of nip member 23, which faces second main surface 22*b* of pressure pad 22A, has a planar shape, whereas second main surface 22*b* of pressure pad 22A has a predetermined irregular shape.

More specifically, as shown in FIGS. 5A, 5B, and 6A to 6C, second main surface 22*b* of pressure pad 22A is provided with a plurality of recesses 22*e*. Recesses 22*e* are configured such that the entire perimeter of each of them is surrounded by projections 22*f* in the direction orthogonal to pressing direction DR1 of pressure roller 10.

In the present embodiment, each of recesses 22*e* is configured to have a rectangular shape in plan view. Recesses 22*e* each having a rectangular shape in plan view are disposed to be arranged in the width direction of pressure pad 22A (i.e., the width direction of fixing belt 21) and direction of transport DR2 of sheet S, and are accordingly arranged in matrix. Projections 22*f* surrounding recesses 22*e* are formed in a lattice shape in plan view.

Second main surface 22*b* of pressure pad 22A is accordingly defined by the top surfaces of lattice-shaped projections 22*f*. In the pressed state in which pressure pad 22A is pressed by pressure roller 10, the top surfaces of lattice-shaped projections 22*f* are in close contact with receiving portion 23*a* of nip member 23.

As shown in FIG. 6A, as viewed in pressing direction DR1, the widths of projections 22*f* extending in direction of transport DR2 of sheet S (i.e., the dimension of projection 22*f* in the width direction of pressure pad 22A) are set to an equal predetermined width W1, and the widths of projections 22*f* extending in the width direction of pressure pad 22A (i.e., the dimension of projection 22*f* in direction of transport DR2 of sheet S) are set to an equal predetermined width W2.

As viewed in pressing direction DR1, the intervals between projections 22*f* arranged in the width direction of pressure pad 22A (i.e., the width of recess 22*e* between projection parts 22*f*) are set to an equal predetermined distance G1, and the intervals between projections 22*f* arranged in direction of transport DR2 of sheet S (i.e., the width of recess 22*e* between projections 22*f*) are set to an equal predetermined distance G2.

Contrastingly, as shown in FIGS. 6B and 6C, all the depths of recesses 22*e* are set to an equal predetermined depth D.

Such a configuration allows recesses 22*e* and lattice-shaped projections 22*f* to be provided substantially evenly in second main surface 22*b* of pressure pad 22A. In the pressed state in which pressure pad 22A is pressed by pressure roller 10, accordingly, the pressure applied to pressure pad 22A and receiving portion 23*a* of nip member 23 can be distributed while securing a contact area therebetween.

As a result, the entire region of second main surface 22*b* of pressure pad 22A abuts against receiving portion 23*a* at an almost equal pressure, allowing pressure to be applied to sheet S without any variations almost as intended in the entire region of nip portion N. This avoids, for example, occurrence of pressure distribution in which the pressure applied to sheet S locally increases. The adoption of the above configuration can suppress occurrence of an uneven image formed on sheet S.

From the viewpoint of applying pressure to sheet S without any variations almost as intended in the entire sheet passing region R1 provided at nip portion N, it suffices that at least recesses 22*e* and lattice-shaped projections 22*f* described above are provided substantially evenly in the portion of second main surface 22*b* which corresponds to sheet passing region R1.

The adoption of the above configuration reduces the thermal capacity of pressure pad 22A by an amount of recesses 22*e* provided. An increase in thermal capacity can also be suppressed in the entire fixing device 8, contributing to reduced energy consumption.

In the present embodiment, some of lattice-shaped projections 22*f* described above form an upstream elongated protrusion 22*g*1 extending in the width direction of pressure pad 22A which is provided at the edge of second main surface 22*b* of pressure pad 22A which corresponds to the upstream position in direction of transport DR2 of sheet S, and a downstream elongated protrusion 22*g*2 extending in the width direction of pressure pad 22A which is provided at the edge of second main surface 22*b* of pressure pad 22A which corresponds to the downstream position in direction of transport DR2 of sheet S. Both of upstream elongated protrusion 22*g*1 and downstream elongated protrusion 22*g*2 reach the opposite ends in the width direction of the portion corresponding to sheet passing region R1 provided at nip portion N.

Such a configuration allows stable and appropriate application of pressure to sheet S supplied to nip portion N at the entrance portion and the exit portion of nip portion N, effectively suppressing occurrence of an uneven image formed.

In fixing device 8 according to the present embodiment, the adoption of the above configuration allows the entire region of second main surface 22*b* of pressure pad 22A to abut against receiving portion 23*a* of nip member 23 at an almost equal pressure. This yields a secondary effect that complicated distribution of the pressure to be applied to sheet S at nip portion N is enabled by the shape of first main surface 22*a* of pressure pad 22A. This will be described below in detail.

Generally, in order to obtain a high quality image, it is important to appropriately control the pressure distribution at a nip portion in the direction of transport of the sheet, in addition to uniformalization of pressure in the width direction of the portion of the nip portion which corresponds to the sheet passing region. Herein, the pressure is desirably distributed at the nip portion in the direction of transport of the sheet such that pressure is relatively low at the entrance portion of the nip portion and is relatively high at the exit portion of the nip portion.

This is because in fixing of a toner image, the toner adhering to the surface of the sheet is first melted sufficiently, and the melted toner is then pressed toward the sheet at a higher pressure, thereby achieving a high quality image. If pressure is increased at the entrance portion of the nip portion, part of the melted toner is pressed strongly toward the sheet before the entire toner melts sufficiently, which causes uneven fixing.

Figure 7:
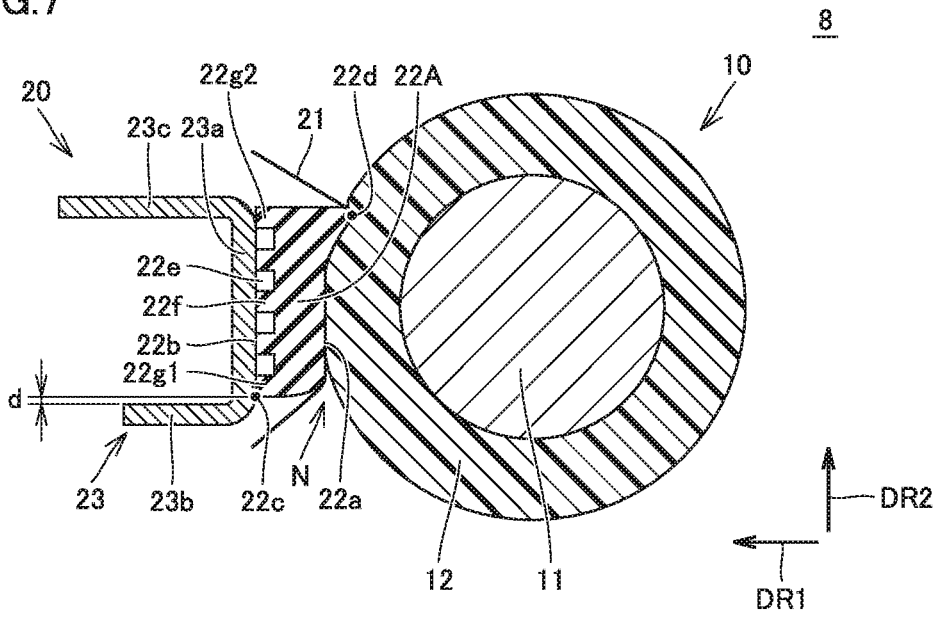
FIG. 7 is a schematic sectional view of main parts of the fixing device shown in FIG. 2 during fixing operation.

In this respect, fixing device 8 according to the present embodiment has a characteristic shape of first main surface 22*a* of pressure pad 22A, thereby solving the above problem. FIG. 7 is a schematic sectional view of main parts of the fixing device shown in FIG. 2 during fixing operation.

Specifically, fixing device 8 according to the present embodiment is configured such that a projecting amount of first main surface 22*a* of pressure pad 22A toward pressure roller 10 is generally constant at the upstream portion (this portion corresponds to the entrance portion of nip portion N) in direction of transport DR2 of sheet S and generally gradually increases from a central vicinity portion (this portion corresponds to the vicinity of the intermediate portion between the entrance portion and the exit portion of nip portion N) in direction of transport DR2 of sheet S toward a downstream portion (this portion corresponds to the exit portion of nip portion N) in direction of transport DR2 of sheet S.

That is to say, of the portion of first main surface 22*a* of pressure pad 22A which corresponds to sheet passing region R1 of nip portion N, a downstream end 22*d* in direction of transport DR2 of sheet S projects toward pressure roller 10.

The adoption of the above configuration can thus optimize the pressure distribution at nip portion N in direction of transport DR2 of sheet S as described above, achieving a high quality image. In addition, when the above configuration is adopted, toner melted at the exit portion of nip portion N can be pressed toward sheet S reliably, which also increases the separability of sheet S from fixing belt 21 after sheet S passes through nip portion N.

Further, fixing device 8 according to the present embodiment is configured such that in the pressed state in which pressure pad 22A is pressed by pressure roller 10, second main surface 22*b* of pressure pad 22A abuts against receiving portion 23*a* of nip member 23 at a position that is, in direction of transport DR2 of sheet S, downstream of a position corresponding to upstanding wall portion 23*b* of nip member 23 which is located upstream in direction of transport DR2 of sheet S.

That is to say, of the portion of second main surface 22*b* of pressure pad 22A which corresponds to sheet passing region R1 of nip portion N, an upstream end 22*c* in direction of transport DR2 of sheet S is disposed at a position backward of upstanding wall portion 23*b* of nip member 23 by a distance d in direction of transport DR2 of sheet S.

Of receiving portion 23*a* of nip member 23, the above-mentioned portion at which upstanding wall portion 23*b* is provided is less likely to bend than the portion at which upstanding wall portion 23*b* is not provided, because upstanding wall portion 23*b* functions as a reinforcing rib. In the configuration in which pressure pad 22A abuts against the portion of the receiving portion 23*a* which is provided with upstanding wall portion 23*b*, a pressure higher than necessary may be applied to sheet S at nip portion N at the position corresponding to the relevant portion.

Thus, the above configuration can prevent an increase in the pressure applied to sheet S at the entrance portion of nip portion N, allowing the toner adhering to the surface of sheet S to be melted sufficiently at the entrance portion of nip portion N. Accordingly, the above configuration can more appropriately control the pressure distribution at nip portion N in direction of transport DR2 of sheet S.

[Modification 1]

Figure 8:
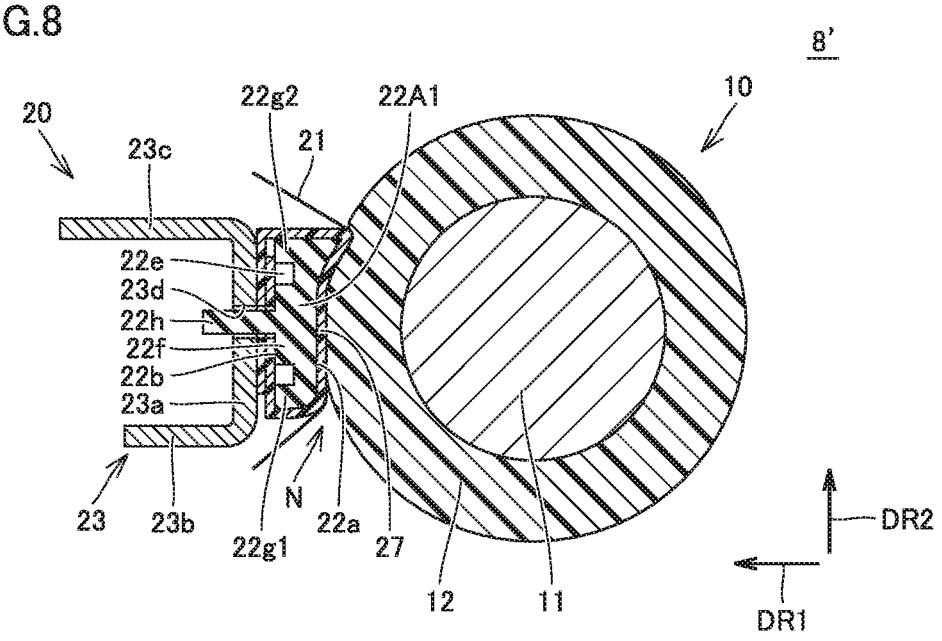
FIG. 8 is a schematic sectional view of main parts of a fixing device according to Modification 1 during fixing operation.
Figure 9:
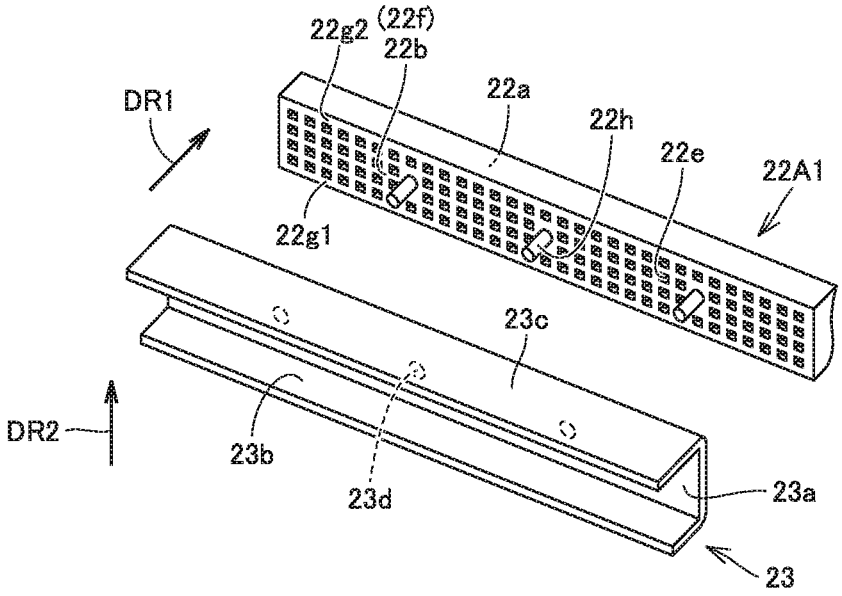
FIG. 9 is a schematic view showing the shapes of a pressure pad and a nip member of the fixing device shown in FIG. 8.

FIG. 8 is a schematic sectional view of main parts of a fixing device according to Modification 1, and FIG. 9 is a schematic view showing the shapes of a pressure pad and a nip member of the fixing device shown in FIG. 8.

A fixing device 8' according to Modification 1 based on Embodiment 1 described above will now be described with reference to FIGS. 8 and 9. FIG. 9 shows a pressure pad 22A1 and nip member 23 as viewed from heating roller 24 side.

As shown in FIG. 8, fixing device 8' according to the present modification includes a low-friction member 27 covering first main surface 22*a* and second main surface 22*b* of pressure pad 22A1. Low-friction member 27 is a member for maintaining good slidability of fixing belt 21 on first main surface 22*a* of pressure pad 22A1 and is formed of, for example, a sliding sheet having a small frictional resistance on its surface.

The sliding sheet is typically a sheet mainly made of, for example, glass cloth with its surface covered with a coating layer such as fluorine-based resin. Alternatively, the sliding sheet may be a fabric of fluorine containing fiber or a fluorine-based resin sheet. Alternatively, the surface of pressure pad 22A1 may be covered with a coating layer of glass or fluorine-based resin without low-friction member 27 formed of a member separate from pressure pad 22A1, thereby forming the sliding sheet as a member integrated with pressure pad 22A1.

Herein, in fixing device 8' according to the present modification, low-friction member 27 is formed of a sliding sheet, and the sliding sheet is wound to surround pressure pad 22A1 about an axis parallel to the width direction of fixing belt 21. Consequently, the sliding sheet is assembled to pressure pad 22A1.

More specifically, as shown in FIGS. 8 and 9, in fixing device 8' according to the present modification, hole portions are provided in the portions of the sliding sheet which cover second main surface 22*b*, and engagement pins 22*h*, which project from second main surface 22*b* toward nip member 23 to be inserted into the hole portions of the sliding sheet, are provided to pressure pad 22A1, thereby assembling the sliding sheet to pressure pad 22A1.

Further, engagement pins 22*h* provided in pressure pad 22A1 are inserted through hole portions 23*d* provided in receiving portion 23*a* of nip member 23, causing pressure pad 22A1 with the sliding sheet wound therearound to be lightly held by nip member 23.

This configuration can suppress occurrence of an uneven image while improving the slidability of fixing belt 21.

[Modification 2]

Figure 10:
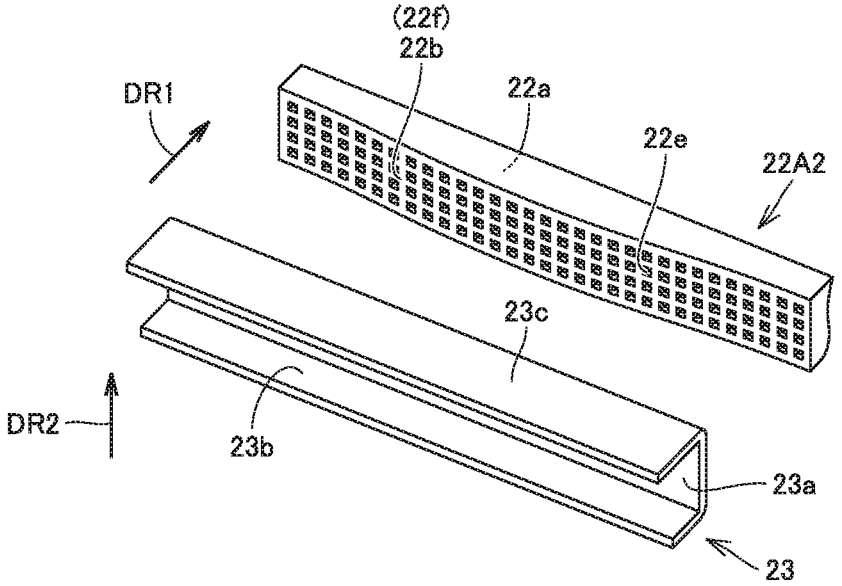
FIG. 10 is a schematic view showing the shapes of a pressure pad and a nip member of a fixing device according to Modification 2.

FIG. 10 is a schematic view showing the shapes of a pressure pad and a nip member of a fixing device according to Modification 2. The fixing device according to Modification 2 based on Embodiment 1 described above will now be described with reference to FIG. 10. FIG. 10 shows a pressure pad 22A2 and nip member 23 as each viewed from heating roller 24 side.

As shown in FIG. 10, in the fixing device according to the present embodiment, with pressure pad 22A2 not being pressed by pressure roller 10, the central portion in the width direction of a portion of second main surface 22*b* which corresponds to sheet passing region R1 provided at nip portion N is shaped to bulge toward receiving portion 23*a* of nip member 23 with respect to opposite ends in the width direction of the portion of second main surface 22*b* which corresponds to sheet passing region R1 provided at nip portion N. Second main surface 22*b* of pressure pad 22A2 accordingly has a so-called normal crown shape.

Herein, when the pressure pad is formed of an elongated-plate member and the receiving portion of the nip member is formed into a flat plate, the pressing force of the pressure roller during fixing operation is extremely high. This may cause bending in the pressure pad, as well as bending in the receiving portion of the nip member reinforcing the pressure pad. At the occurrence of such bending, the distribution of the pressure applied to the sheet at the nip portion varies greatly in the width direction of the fixing belt, causing uneven fixing, which greatly reduces the quality of an image formed.

In the present modification, thus, the bulge shape described above is provided to second main surface 22*b* of pressure pad 22A2 to absorb a displacement due to the bending of nip member 23 by the bulging portion. This can suppress occurrence of bending of pressure pad 22A2 while bringing the entire region of the portion of second main surface 22*b* which corresponds to sheet passing region R1 provided at nip portion N to close contact with receiving portion 23*a*.

The adoption of the above configuration thus allows a pressure to be generally evenly applied to sheet S in sheet passing region R1 of nip portion N in the axial direction of pressure roller 10 (i.e., the width direction of fixing belt 21). A toner image can be accordingly fixed onto the entire region in the width direction of nip portion N without unevenness, thereby greatly improving the quality of an image formed.

[Modifications 3 to 5]

Figure 11A:
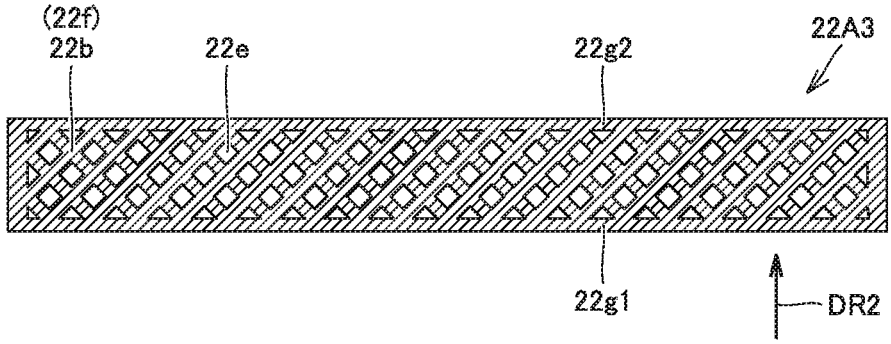
FIG. 11A is a rear view of a pressure pad of a fixing device according to Modification 3.
Figure 11B:
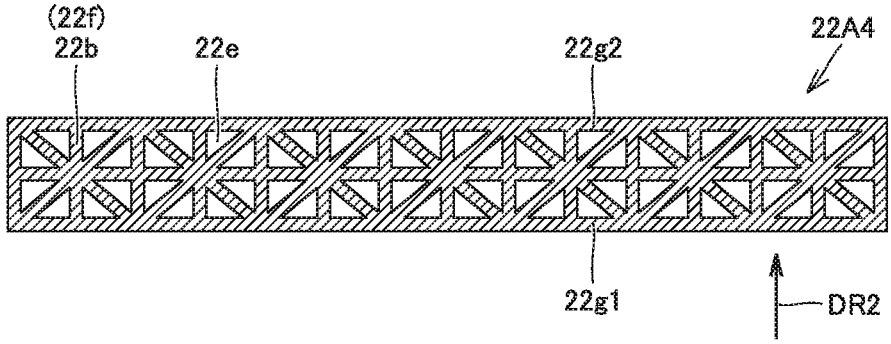
FIG. 11B is a rear view of a pressure pad of a fixing device according to Modification 4.
Figure 11C:
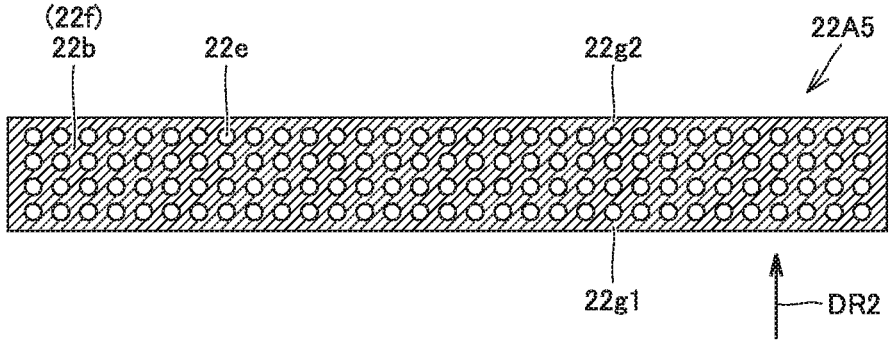
FIG. 11C is a rear view of a pressure pad of a fixing device according to Modification 5.

FIGS. 11A to 11C are rear views of pressure pads of fixing devices according to Modifications 3 to 5, respectively. The fixing devices according to Modifications 3 to 5 based on Embodiment 1 described above will now be described with reference to FIGS. 11A to 11C.

The fixing devices according to Modifications 3 to 5 are configured such that the entire regions of second main surfaces 22*b* of pressure pads 22A3 to 22A5 abut against receiving portion 23*a* of nip member 23 at an almost equal pressure, as in fixing device 8 according to Embodiment 1 described above.

That is to say, pressure pad 22A3 of the fixing device according to Modification 3 shown in FIG. 11A is configured as follows: by providing projections 22*f*, each of which obliquely extends and is shaped into an elongated projection, to intersect each other, recesses 22*e* each having a rectangular shape in plan view are provided in second main surface 22*b* of pressure pad 22A3 such that the top surfaces of projections 22*f* having an obliquely lattice shape as a whole form second main surface 22*b*.

Pressure pad 22A4 of the fixing device according to Modification 4 shown in FIG. 11B is configured as follows: recesses 22*e* each having a triangular shape in plan view are provided in second main surface 22*b* of pressure pad 22A4 such that the top surfaces of truss-shaped projections 22*f* form second main surface 22*b*.

In contrast, pressure pad 22A5 of the fixing device according to Modification 5 shown in FIG. 11C is configured as follows: recesses 22*e* each having a circular shape in plan view are provided in second main surface 22*b* of pressure pad 22A5 such that the top surfaces of projections 22*f* having a generally lattice shape form second main surface 22*b*.

Also when any of these configurations is adopted, the effects similar to those described in Embodiment 1 can be achieved, allowing application of pressure to sheet S without any variations almost as intended in the entire region of nip portion N. This can suppress occurrence of an uneven image formed on sheet S.

Configuration Example 1 and Modifications Thereof

Figure 12A:
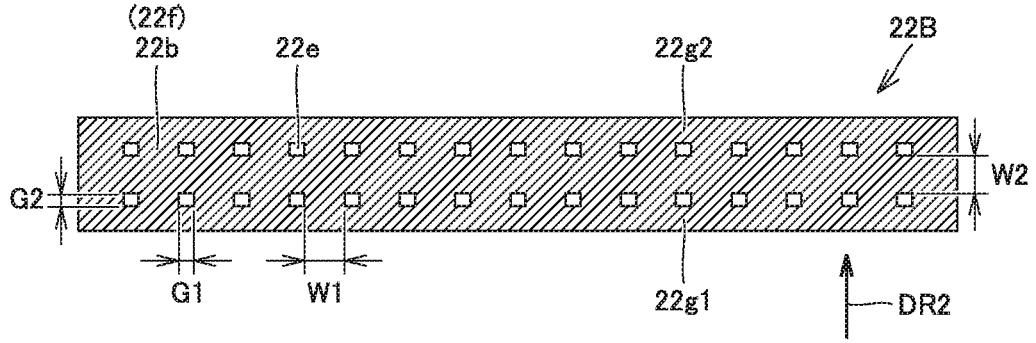
FIG. 12A is a rear view of a pressure pad according to Configuration Example 1.
Figure 12B:
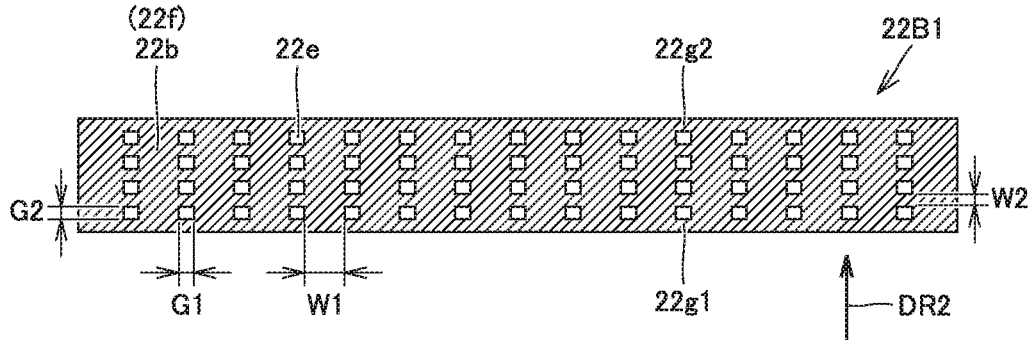
FIG. 12B is a rear view of a pressure pad according to a modification of Configuration Example 1.
Figure 12C:
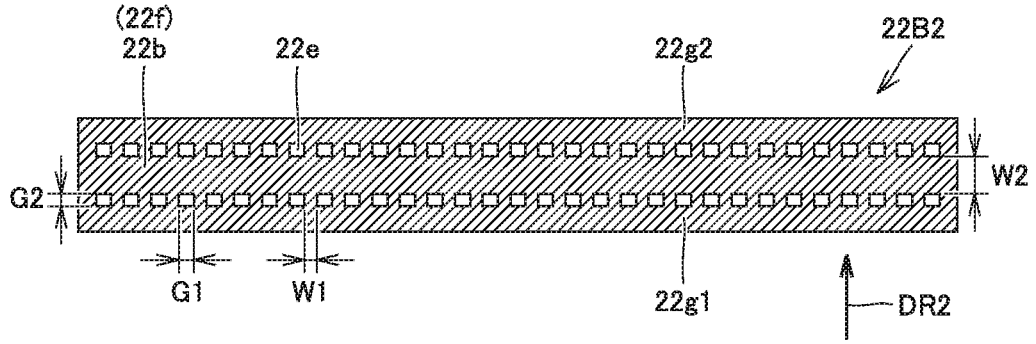
FIG. 12C is a rear view of a pressure pad according to another modification of Configuration Example 1.

FIG. 12A is a rear view of a pressure pad according to Configuration Example 1, FIG. 12B is a rear view of a pressure pad according to a modification of Configuration Example 1, and FIG. 12C is a rear view of a pressure pad according to another modification of Configuration Example 1. Pressure pads 22B, 22B1, and 22B2 according to Configuration Example 1 and the modifications thereof will now be described with reference to FIGS. 12A to 12C. In place of pressure pad 22A of fixing device 8 according to Embodiment 1 described above, pressure pads 22B, 22B1, and 22B2 according to Configuration Example 1 and the modifications thereof are included in fixing device 8.

Pressure pads 22B, 22B1, and 22B2 according to Configuration Example 1 and the modifications thereof shown in FIGS. 12A to 12C are suitable for the case in which a pressure higher than that applied to pressure pad 22A according to Embodiment 1 described above is applied to sheet S at nip portion N.

That is to say, pressure pad 22B according to Configuration Example 1 shown in FIG. 12A is configured such that width W1 of projections 22*f* extending in direction of transport DR2 of sheet S and width W2 of projections 22*f* extending in the width direction of pressure pad 22B are greater than those of pressure pad 22A according to Embodiment 1 described above.

Pressure pad 22B1 according to the modification of Configuration Example 1 shown in FIG. 12B is configured such that width W1 of projections 22*f* extending in direction of transport DR2 of sheet S is greater than that of pressure pad 22A according to Embodiment 1 described above.

In contrast, pressure pad 22B2 according to the other modification of Configuration Example 1 shown in FIG. 12C is configured such that width W2 of projections 22*f* extending in the width direction of pressure pad 22B2 is greater than that of pressure pad 22A according to Embodiment 1 described above.

Also when any of these configurations is adopted, compared with Embodiment 1 described above, a high pressure can be applied to sheet S at nip portion N along with an increase in the contact area between pressure pads 22B, 22B1, and 22B2 and receiving portion 23*a* of nip member 23, and can also distribute the pressure applied thereto.

Also when any of these configurations is adopted, thus, the effects similar to those described in Embodiment 1 can be achieved, allowing pressure to be applied to sheet S without any variations almost as intended in the entire region of nip portion N. This can suppress occurrence of an uneven image formed on sheet S.

Configuration Example 2 and Modifications Thereof

Figure 13A:
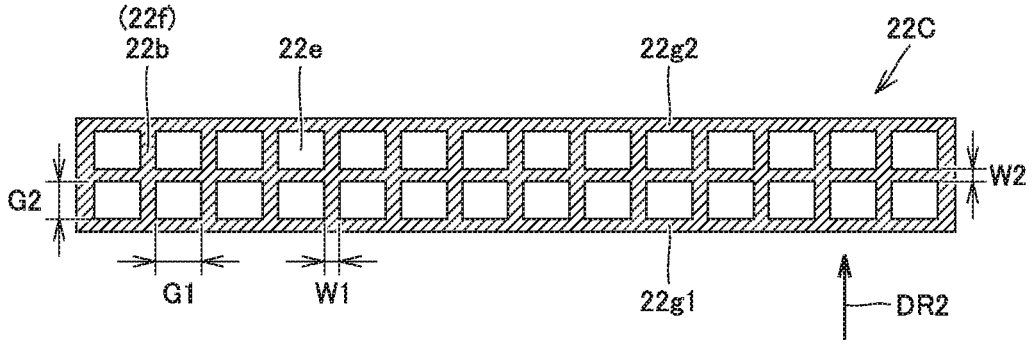
FIG. 13A is a rear view of a pressure pad according to Configuration Example 2.
Figure 13B:
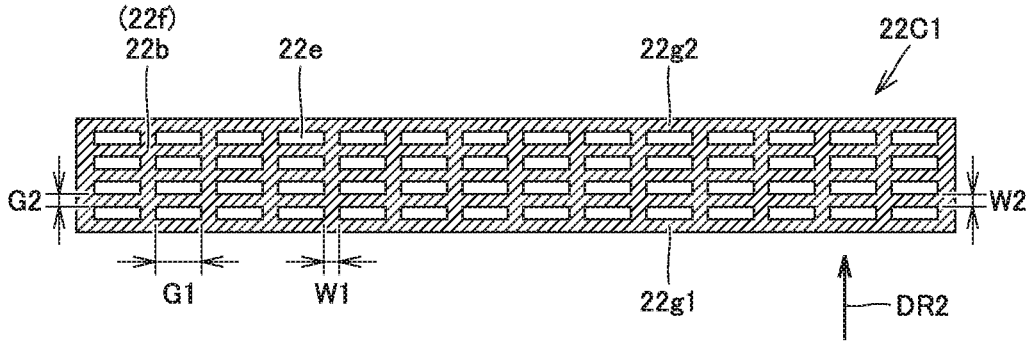
FIG. 13B is a rear view of a pressure pad according to a modification of Configuration Example 2.
Figure 13C:
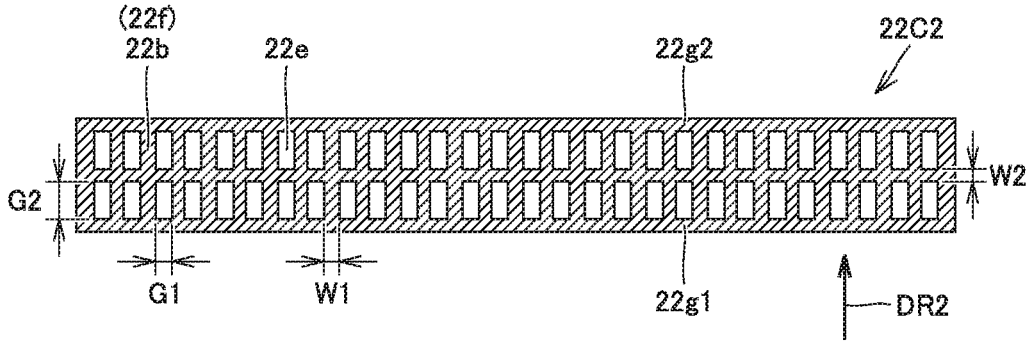
FIG. 13 C is a rear view of a pressure pad according to another modification of Configuration Example 2.

FIG. 13A is a rear view of a pressure pad according to Configuration Example 2, FIG. 13B is a rear view of a pressure pad according to a modification of Configuration Example 2, and FIG. 13C is a rear view of a pressure pad according to another modification of Configuration Example 2. Pressure pads 22C, 22C1, and 22C2 according to Configuration Example 2 and the modifications thereof will now be described with reference to FIGS. 13A to 13C. In place of pressure pad 22A of fixing device 8 according to Embodiment 1 described above, pressure pads 22C, 22C1, and 22C2 according to Configuration Example 2 and the modifications thereof are included in fixing device 8.

Pressure pads 22C, 22C1, and 22C2 according to Configuration Example 2 and the modifications thereof shown in FIGS. 13A to 13C are suitable for the case in which thermal capacity can be reduced more than that of pressure pad 22A according to Embodiment 1 described above.

That is to say, pressure pad 22C according to Configuration Example 2 shown in FIG. 13A is configured such that interval G1 between projections 22*f* arranged in the width direction of pressure pad 22C and interval G2 between projections 22*f* arranged in direction of transport DR2 of sheet S are greater than those of pressure pad 22A according to Embodiment 1 described above.

Pressure pad 22C1 according to the modification of Configuration Example 2 shown in FIG. 13B is configured such that interval G1 between projections 22*f* arranged in the width direction of pressure pad 22C1 is greater than that of pressure pad 22A according to Embodiment 1 described above.

In contrast, pressure pad 22C2 according to the other modification of Configuration Example 2 shown in FIG. 13C is configured such that interval G2 between projections 22*f* arranged in direction of transport DR2 of sheet S is greater than that of pressure pad 22A according to Embodiment 1 described above.

Also when any of these configurations is adopted, compared with Embodiment 1 described above, thermal capacity can be reduced further with an increasing capacity of recesses 22*e* provided in pressure pads 22C, 22C1, and 22C2, and the pressure applied to pressure pads 22C, 22C1, and 22C2 and nip member 23 can be distributed.

Also when any of these configurations is adopted, effects similar to those described in Embodiment 1 can be achieved, allowing pressure to be applied to sheet S without any variations almost as intended in the entire region of nip portion N. This can suppress occurrence of an uneven image formed on sheet S.

Configuration Example 3 and Modifications Thereof

Figure 14A:
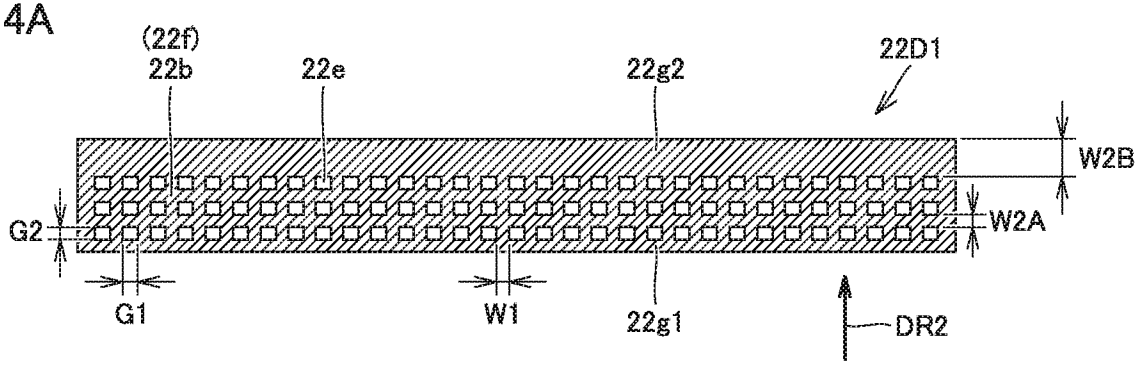
FIG. 14A is a rear view of a pressure pad according to Configuration Example 3.
Figure 14B:
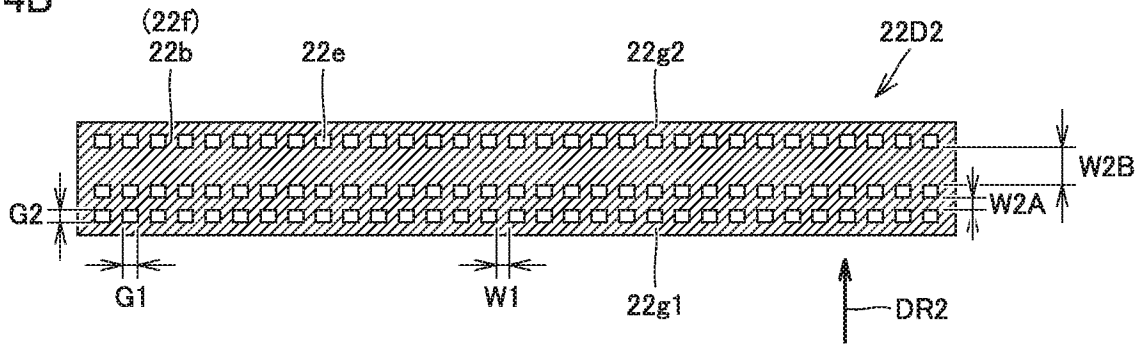
FIG. 14B is a rear view of a pressure pad according to a modification of Configuration Example 3.

FIG. 14A is a rear view of a pressure pad according to Configuration Example 3, and FIG. 14B is a rear view of a pressure pad according to a modification of Configuration Example 3. Pressure pads 22D1 and 22D2 according to Configuration Example 3 and the modification thereof will now be described with reference to FIGS. 14A and 14B. In place of pressure pad 22A of fixing device 8 according to Embodiment 1 described above, pressure pads 22D1 and 22D2 according to Configuration Example 3 and the modification thereof are included in fixing device 8.

Pressure pads 22D1 and 22D2 according to Configuration Example 3 and the modification thereof shown in FIGS. 14A and 14B have recesses 22*e* and lattice-shaped projections 22*f* provided substantially unevenly in second main surface 22*b*, unlike pressure pad 22A according to Embodiment 1 described above. This provides changes in the pressure applied to sheet S at nip portion N in direction of transport DR2 of sheet S.

That is to say, pressure pad 22D1 according to Configuration Example 3 shown in FIG. 14A is configured as follows: of the widths of projections 22*f* extending in the width direction of pressure pad 22B, a width W2B of projection 22*f* provided in the portion of second main surface 22*b* which corresponds to the downstream position in direction of transport DR2 of sheet S is greater than a width W2A of projections 22*f* provided in the portion of second main surface 22*b* which corresponds to the upstream position in direction of transport DR2 of sheet S.

Pressure pad 22D2 according to the modification of Configuration Example 3 shown in FIG. 14B is configured as follows: of the widths of projections 22*f* extending in the width direction of pressure pad 22B, width W2B of projection 22*f* provided in the portion of second main surface 22*b* which corresponds to a position slightly downstream of the intermediate position in direction of transport DR2 of sheet S is greater than width W2A of projection 22*f* provided at another position.

When these configurations are adopted, the pressure applied to pressure pads 22D1 and 22D2 and nip member 23 can be distributed while providing changes in the pressure applied to sheet S at nip portion N in direction of transport DR2 of sheet S. Thus, similarly to pressure pads 22D1 and 22D2 according to Configuration Example 3 and the modification thereof, by varying the widths of projection 22*f* extending widthwise in accordance with the position on second main surface 22*b*, pressure can be applied to sheet S without any variations almost as intended in the entire region of nip portion N while appropriately controlling the pressure distribution at nip portion N in direction of transport DR2 of sheet S.

In the cases of pressure pads 22D1 and 22D2 according to Configuration Example 3 and the modification thereof, the pressure distribution at nip portion N in direction of transport DR2 of sheet S can be made such that pressure is relatively low at the entrance portion of nip portion N and is relatively high at the exit portion of nip portion N. In fixing of a toner image, thus, toner adhering to the surface of sheet S can be first melted sufficiently, and subsequently, the melted toner can be pressed toward sheet S at a higher pressure, thereby achieving a high quality image free from unevenness.

Configuration Example 4 and Modification Thereof

Figure 15A:
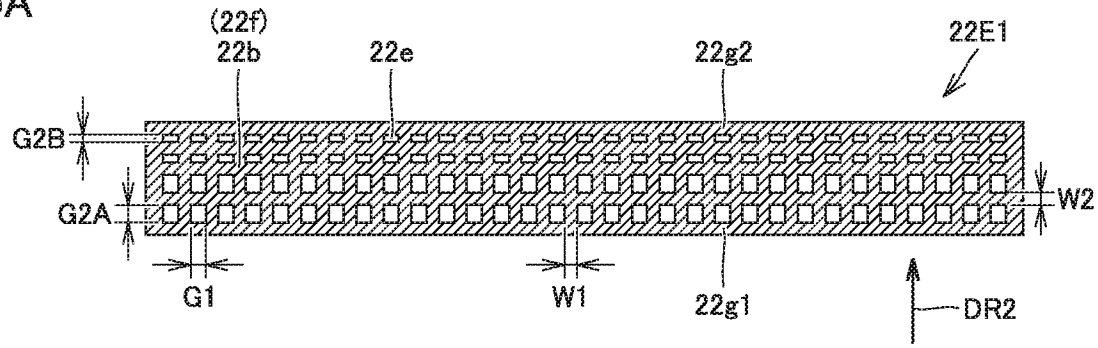
FIG. 15A is a rear view of a pressure pad according to Configuration Example 4.
Figure 15B:
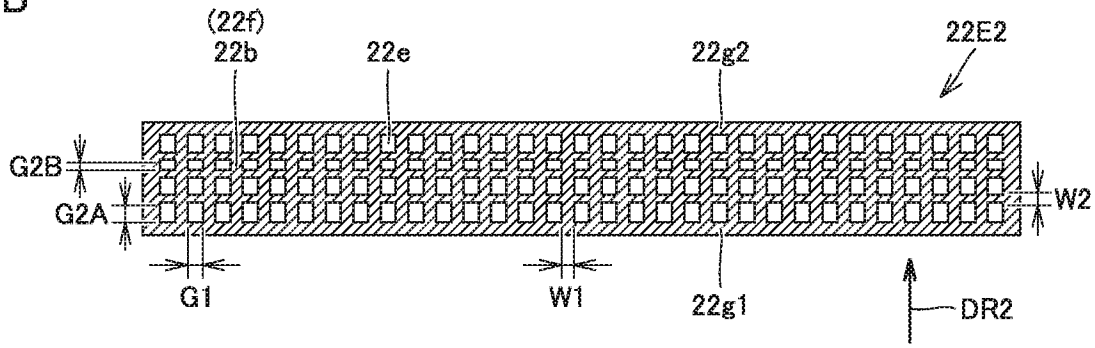
FIG. 15B is a rear view of a pressure pad according to a modification of Configuration Example 4.

FIG. 15A is a rear view of a pressure pad according to Configuration Example 4, and FIG. 15B is a rear view of a pressure pad according to a modification of Configuration Example 4. Pressure pads 22E1 and 22E2 according to Configuration Example 4 and the modification thereof will now be described with reference to FIGS. 15A and 15B. In place of pressure pad 22A of fixing device 8 according to Embodiment 1 described above, pressure pads 22E1 and 22E2 according to Configuration Example 4 and the modification thereof are included in fixing device 8.

Pressure pads 22E1 and 22E2 according to Configuration Example 4 and the modification thereof shown in FIGS. 15A and 15B have recesses 22*e* and lattice-shaped projections 22*f* provided substantially unevenly in second main surface 22*b*, unlike pressure pad 22A according to Embodiment 1 described above. This provides changes in the pressure applied to sheet S at nip portion N in direction of transport DR2 of sheet S.

That is to say, pressure pad 22E1 according to Configuration Example 4 shown in FIG. 15A is configured as follows: of the intervals between projections 22*f* arranged in direction of transport DR2 of sheet S, an interval G2B between projections 22*f* provided in the portion of second main surface 22*b* which corresponds to a downstream position in direction of transport DR2 of sheet S is smaller than an interval G2A between projections 22*f* provided in the portion of second main surface 22*b* which corresponds to an upstream position in direction of transport DR2 of sheet S.

Pressure pad 22E2 according to the modification of Configuration Example 4 shown in FIG. 15B is configured as follows: of the intervals between portions of projections 22*f* which are arranged in direction of transport DR2 of sheet S, interval G2B between projections 22*f* provided in the portion of second main surface 22*b* which corresponds to a position slightly downstream of the intermediate position in direction of transport DR2 of sheet S is smaller than an interval G2A between projections 22*f* provided at other positions.

When these configurations are adopted, the pressure applied to pressure pads 22E1 and 22E2 and nip member 23 can be distributed while providing changes in the pressure applied to sheet S at nip portion N in direction of transport DR2 of sheet S. Thus, similarly to pressure pads 22E1 and 22E2 according to Configuration Example 4 and the modification thereof, by varying the interval between projections 22*f* arranged in direction of transport DR2 of sheet S in accordance with the position on second main surface 22*b*, pressure can be applied to sheet S without any variations almost as intended in the entire region of nip portion N while appropriately controlling the pressure distribution at nip portion N in direction of transport DR2 of sheet S.

In the cases of pressure pads 22E1 and 22E2 according to Configuration Example 4 and the modification thereof, the pressure distribution at nip portion N in direction of transport DR2 of sheet S can be made such that pressure is relatively low at the entrance portion of nip portion N and is relatively high at the exit portion of nip portion N. In fixing of a toner image, thus, toner adhering to the surface of sheet S can be first melted sufficiently, and subsequently, the melted toner can be pressed toward sheet S at a higher pressure, thereby achieving a high quality image free from unevenness.

Configuration Example 5 and Modification Thereof

Figure 16B:
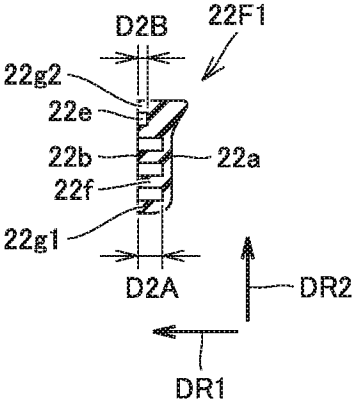
FIGS. 16B and 16C are sectional views of the pressure pad according to Configuration Example 5.
Figure 16A:
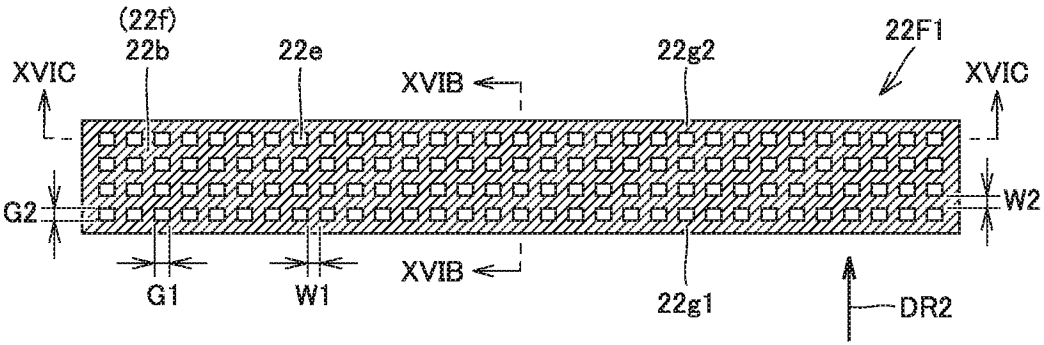
FIG. 16A is a rear view of a pressure pad according to Configuration Example 5.
Figure 16C:
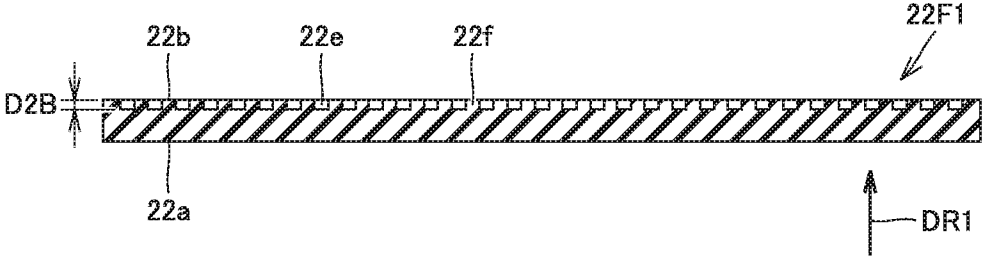
Figure 17B:
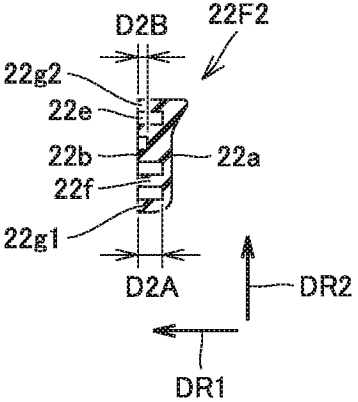
FIGS. 17B and 17C are sectional views of the pressure pad according to the modification of Configuration Example 5.
Figure 17A:
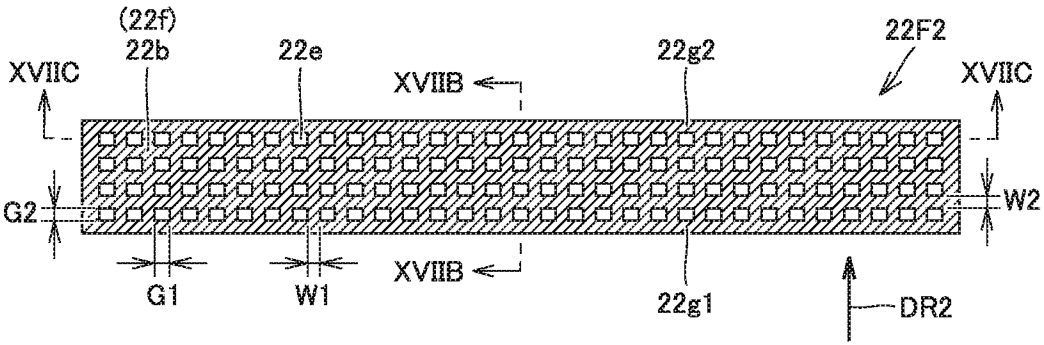
FIG. 17A is a rear view of a pressure pad according to a modification of Configuration Example 5.
Figure 17C:
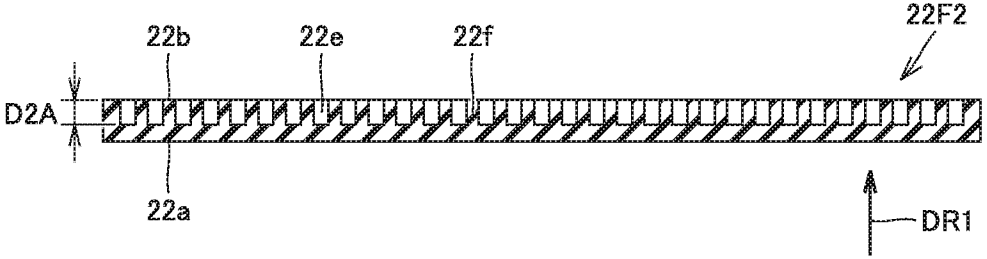

FIG. 16A is a rear view of a pressure pad according to Configuration Example 5, and FIGS. 16B and 16C are sectional views of the pressure pad according to Configuration Example 5. FIG. 17A is a rear view of a pressure pad according to a modification of Configuration Example 5, and FIGS. 17B and 17C are sectional views of the pressure pad according to the modification of Configuration Example 5. Pressure pads 22F1 and 22F2 according to Configuration Example 5 and the modification thereof will now be described with reference to FIGS. 16A to 16C and 17A to 17C. In place of pressure pad 22A of fixing device 8 according to Embodiment 1 described above, pressure pads 22F1 and 22F2 according to Configuration Example 5 and the modification thereof are included in fixing device 8.

Herein, FIGS. 16B and 16C show cross-sections taken along line XVIB-XVIB and line XVIC-XVIC in FIG. 16A, respectively, and FIGS. 17B and 17C show cross-sections taken along line XVIIB-XVIIB and line XVIIC-XVIIC shown in FIG. 17A, respectively.

Unlike pressure pad 22A according to Embodiment 1 described above, pressure pads 22F1 and 22F2 according to Configuration Example 5 and the modification thereof shown in FIGS. 16A to 16C and 17A to 17C are obtained by substantially evenly providing recesses 22*e* and lattice-shaped projections 22*f* in second main surface 22*b* while providing substantially uneven depths to recesses 22*e* to provide changes in the pressure applied to sheet S at nip portion N in direction of transport DR2 of sheet S.

That is to say, pressure pad 22F1 according to Configuration Example 5 shown in FIGS. 16A to 16C is configured such that a depth D2B of each of recesses 22*e* provided in the portion of second main surface 22*b* which corresponds to a downstream position in direction of transport DR2 of sheet S is smaller than a depth D2A of each of recesses 22*e* provided in the portion of second main surface 22*b* which corresponds to an upstream position in direction of transport DR2 of sheet S.

Pressure pad 22F2 according to the modification of Configuration Example 5 shown in FIGS. 17A to 17C is configured such that depth D2B of each of recesses 22*e* provided in the portion of second main surface 22*b* which corresponds to a position slightly downstream of the intermediate position in direction of transport DR2 of sheet S is smaller than depth D2A of each of recesses 22*e* provided at other positions.

When these configurations are adopted, the pressure applied to pressure pads 22F1 and 22F2 and nip member 23 can be distributed while providing changes in the pressure applied to sheet S at nip portion N in direction of transport DR2 of sheet S. Similarly to pressure pads 22F1 and 22F2 according to Configuration Example 5 and the modification thereof, thus, by varying the depths of recesses 22*e* in accordance with the position on second main surface 22*b*, pressure can be applied to sheet S without any variations almost as intended in the entire region of nip portion N while appropriately controlling the pressure distribution at nip portion N in direction of transport DR2 of sheet S.

In the cases of pressure pads 22F1 and 22F2 according to Configuration Example 5 and the modification thereof, the pressure distribution at nip portion N in direction of transport DR2 of sheet S can be made such that pressure is relatively low at the entrance portion of nip portion N and pressure is relatively high at the exit portion of nip portion N. In fixing of a toner image, thus, toner adhering to the surface of sheet S can be first melted sufficiently, and subsequently, the melted toner can be pressed toward sheet S at a higher pressure, achieving a high quality image free from unevenness.

Configuration Example 6 and Modification Thereof

Figure 18A:
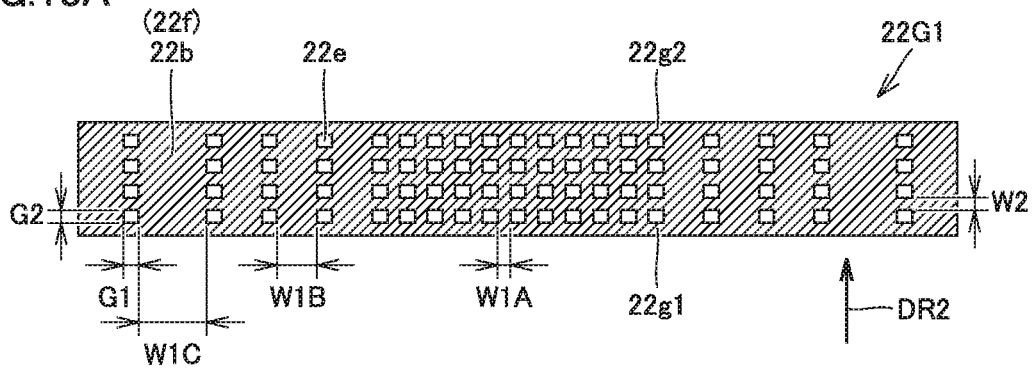
FIG. 18A is a rear view of a pressure pad according to Configuration Example 6.
Figure 18B:
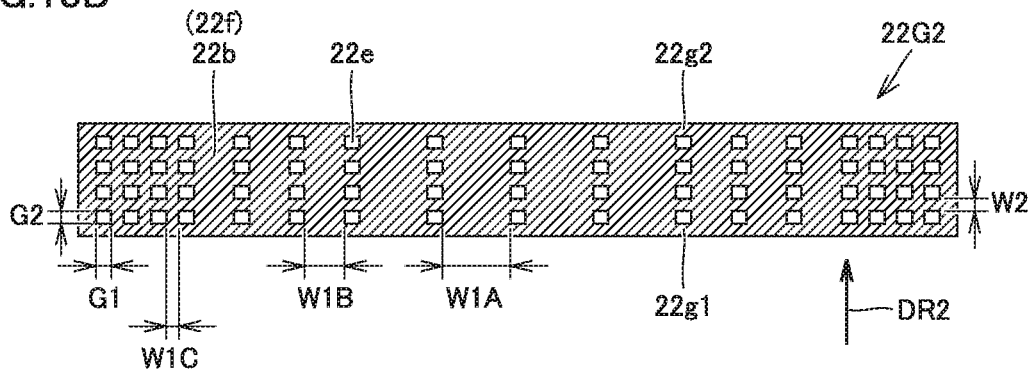
FIG. 18B is a rear view of a pressure pad according to a modification of Configuration Example 6.

FIG. 18A is a rear view of a pressure pad according to Configuration Example 6, and FIG. 18B is a rear view of a pressure pad according to a modification of Configuration Example 6. Pressure pads 22G1 and 22G2 according to Configuration Example 6 and the modification thereof will now be described with reference to FIGS. 18A and 18B. In place of pressure pad 22A of fixing device 8 according to Embodiment 1 described above, pressure pads 22G1 and 22G2 according to Configuration Example 6 and the modification thereof are included in fixing device 8.

Unlike pressure pad 22A according to Embodiment 1 described above, both of pressure pads 22G1 and 22G2 according to Configuration Example 6 and the modification thereof shown in FIGS. 18A and 18B are obtained by providing substantially unevenly recesses 22*e* and lattice-shaped projections 22*f* in second main surface 22*b* to provide changes in the pressure applied to sheet S at nip portion N in the width direction of fixing belt 21 (i.e., the width direction of pressure pads 22G1 and 22G2).

That is to say, pressure pad 22G1 according to Configuration Example 6 shown in FIG. 18A is configured as follow: of the widths of projections 22*f* extending in direction of transport DR2 of sheet S, a width W1C of projections 22*f* provided in the portions of second main surface 22*b* which correspond to the pair of outer regions R2 located outside in the width direction of sheet passing region R1 provided at nip portion N is greater than a width W1B of projections 22*f* provided in the portions of second main surface 22*b* which correspond to the opposite ends in the width direction of sheet passing region R1 provided at nip portion N, and width W1B of projections 22*f* provided in the portions of second main surface 22*b* which correspond to the opposite ends in the width direction of sheet passing region R1 provided at nip portion N is greater than a width W1A of projections 22*f* provided in the portion of second main surface 22*b* which corresponds to the central portion in the width direction of sheet passing region R1 provided at nip portion N.

Pressure pad 22G2 according to the modification of Configuration Example 6 shown in FIG. 18B is configured as follows: of the widths of projections 22*f* extending in direction of transport DR2 of sheet S, width W1A of projections 22*f* provided in the portion of second main surface 22*b* which corresponds to the central portion in the width direction of sheet passing region R1 provided at nip portion N is greater than width W1B of projections 22*f* provided in the portions of second main surface 22*b* which correspond to the opposite ends in the width direction of sheet passing region R1 provided at nip portion N, and widths W1B of projections 22*f* provided in the portions of second main surface 22*b* which correspond to the opposite ends in the width direction of sheet passing region R1 provided at nip portion N are greater than width W1C of projections 22*f* provided in the portions of second main surface 22*b* which correspond to the pair of outer regions R2 located outside in the width direction of sheet passing region R1 provided at nip portion N.

When these configurations are adopted, the pressure applied to pressure pads 22G1 and 22G2 and nip member 23 can be distributed while providing changes in the pressure applied to sheet S at nip portion N in the width direction of fixing belt 21. Similarly to pressure pads 22G1 and 22G2 according to Configuration Example 6 and the modification thereof, thus, by varying the widths of projections 22*f* extending in direction of transport DR2 of sheet S in accordance with the position on second main surface 22*b*, pressure can be applied to sheet S without any variations almost as intended in the entire region of nip portion N while appropriately controlling the pressure distribution at nip portion N in the width direction of fixing belt 21.

Particularly in the case of pressure pad 22G1 according to Configuration Example 6 described above, fixing belt 21 is nipped at the opposite ends in the width direction of nip portion N at a pressure higher than a pressure at the central portion in the width direction of nip portion N, and simultaneously, pressure roller 10 and pressure pad 22G1 are pressed at a greater pressing force in the pair of outer regions R2 located on the outer sides in the width direction of nip portion N. This can suppress occurrence of slippage in fixing belt 21, causing driving fixing belt 21 to rotate following the rotation of pressure roller 10 more reliably. Consequently, sheet S can be transported reliably.

Such a configuration can thus suppress occurrence of poor transportation of sheet S, preventing occurrence of a malfunction such as uneven fixing due to, for example, jamming of sheet S, wrinkling of sheet S, or local overheating of sheet S.

Configuration Example 7 and Modification Thereof

Figure 19A:
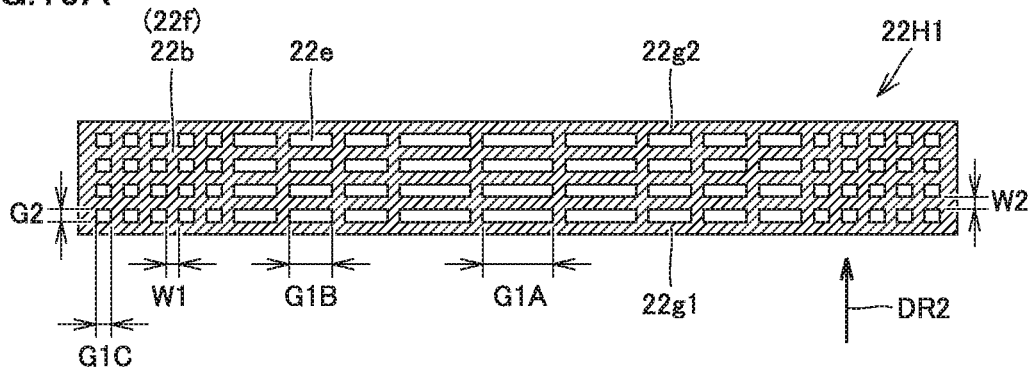
FIG. 19A is a rear view of a pressure pad according to Configuration Example 7.
Figure 19B:
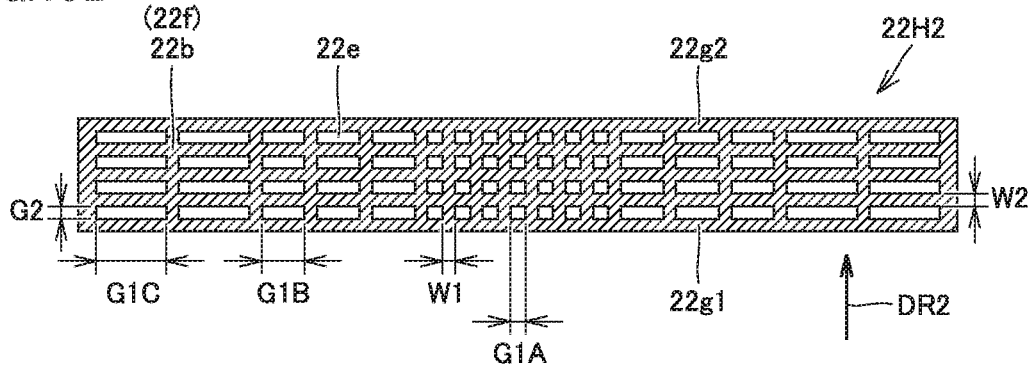
FIG. 19B is a rear view of a pressure pad according to a modification of Configuration Example 7.

FIG. 19A is a rear view of a pressure pad according to Configuration Example 7, and FIG. 19B is a rear view of a pressure pad according to a modification of Configuration Example 7. Pressure pads 22H1 and 22H2 according to Configuration Example 7 and the modification thereof will now be described with reference to FIGS. 19A and 19B. In place of pressure pad 22A of fixing device 8 according to Embodiment 1 described above, pressure pads 22H1 and 22H2 according to Configuration Example 7 and the modification thereof are included in fixing device 8.

Unlike pressure pad 22A according to Embodiment 1 described above, pressure pads 22H1 and 22H2 according to Configuration Example 7 and the modification thereof shown in FIGS. 19A and 19B are obtained by substantially unevenly providing recesses 22*e* and lattice-shaped projections 22*f* in second main surface 22*b*, thereby providing changes in the pressure applied to sheet S at nip portion N in the width direction of fixing belt 21 (i.e., the width direction of pressure pads 22H1 and 22H2).

That is to say, pressure pad 22H1 according to Configuration Example 7 shown in FIG. 19A is configured as follows: of the intervals between projections 22*f* arranged in transportation direction D2 of sheet S, an interval G1C between projections 22*f* provided in the portions of second main surface 22*b* which correspond to the pair of outer regions R2 located outside in the width direction of sheet passing region R1 provided at nip portion N is smaller than an interval G1B between projections 22*f* provided in the portions of second main surface 22*b* which correspond to the opposite ends in the width direction of sheet passing region R1 provided at nip portion N, and interval G1B between projections 22*f* provided in the portions of second main surface 22*b* which correspond to the opposite ends in the width direction of sheet passing region R1 provided at nip portion N is smaller than an interval G1A between projections 22*f* provided in the portion of second main surface 22*b* which corresponds to the central portion in the width direction of sheet passing region R1 provided at nip portion N.

Pressure pad 22H2 according to the modification of Configuration Example 7 shown in FIG. 19B is configured as follows: of the intervals between projections 22*f* arranged in direction of transport DR2 of sheet S, interval G1A between projections 22*f* provided in the portion of second main surface 22*b* which corresponds to the central portion in the width direction of sheet passing region R1 provided at nip portion N is smaller than interval G1B between projections 22*f* provided in the portions of second main surface 22*b* which correspond to the opposite ends in the width direction of sheet passing region R1 provided at nip portion N, and interval G1B between projections 22*f* provided in the portions of second main surface 22*b* which correspond to the opposite ends in the width direction of sheet passing region R1 provided at nip portion N is smaller than interval G1C between projections 22*f* provided in the portions of second main surface 22*b* which correspond to the pair of outer regions R2 located outside in the width direction of sheet passing region R1 provided at nip portion N.

When these configurations are adopted, the pressure applied to pressure pads 22H1 and 22H2 and nip member 23 can be distributed while providing changes in the pressure applied to sheet S at nip portion N in the width direction of fixing belt 21. Similarly to pressure pads 22H1 and 22H2 according to Configuration Example 7 and the modification thereof, thus, by varying the interval between projections 22*f* arranged in the width direction in accordance with the position on second main surface 22*b*, pressure can be applied to sheet S without any variations almost as intended in the entire region of nip portion N while appropriately controlling the pressure distribution at nip portion N in the width direction of fixing belt 21.

Particularly in the case of pressure pad 22H1 according to Configuration Example 7 described above, fixing belt 21 is nipped at a pressure higher than a pressure applied to the central portion in the width direction of nip portion N at opposite ends in the width direction of nip portion N, and in the pair of outer regions R2 located on the outer sides in the width direction of nip portion N, pressure roller 10 and pressure pad 22H1 are pressed at a higher pressing force. This can suppress occurrence of slippage in fixing belt 21, causing driving fixing belt 21 to rotate following the rotation of pressure roller 10 more reliably. Consequently, sheet S can be transported reliably.

Such a configuration can thus suppress occurrence of poor transportation of sheet S, preventing a malfunction such as uneven fixing due to, for example, jamming of sheet S, wrinkling of sheet S, or local overheating of sheet S.

Configuration Example 8 and Modification Thereof

Figure 20B:
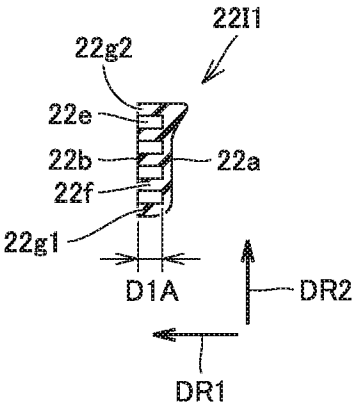
FIGS. 20B and 20C are sectional views of the pressure pad according to Configuration Example 8.
Figure 20A:
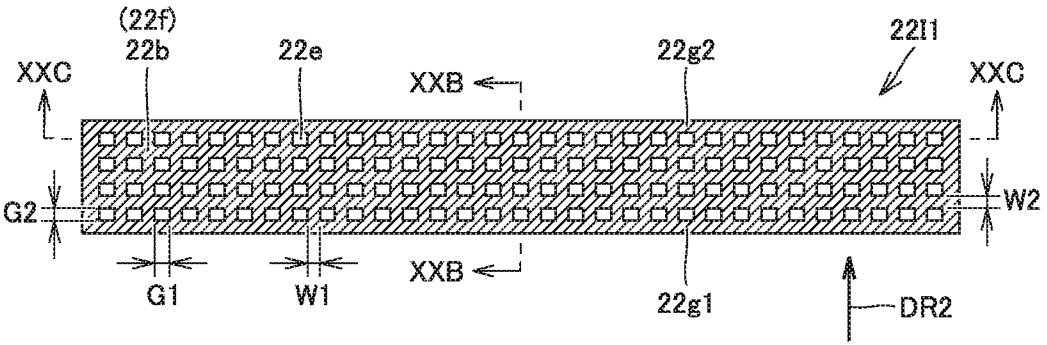
FIG. 20A is a rear view of a pressure pad according to Configuration Example 8.
Figure 20C:
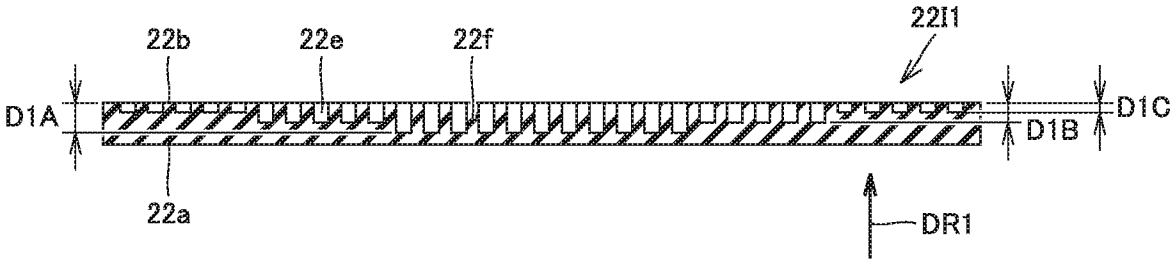
Figure 21B:
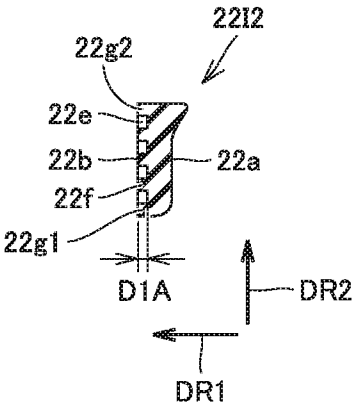
FIGS. 21B and 21C are sectional views of the pressure pad according to the modification of Configuration Example 8.
Figure 21A:
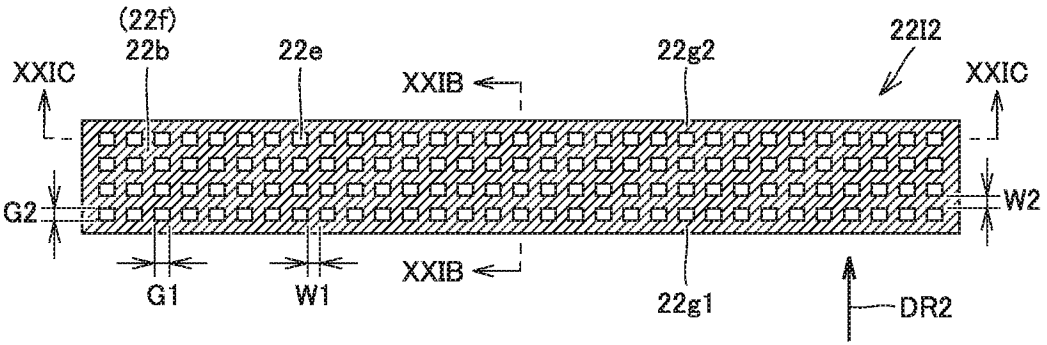
FIG. 21A is a rear view of a pressure pad according to a modification of Configuration Example 8.
Figure 21C:
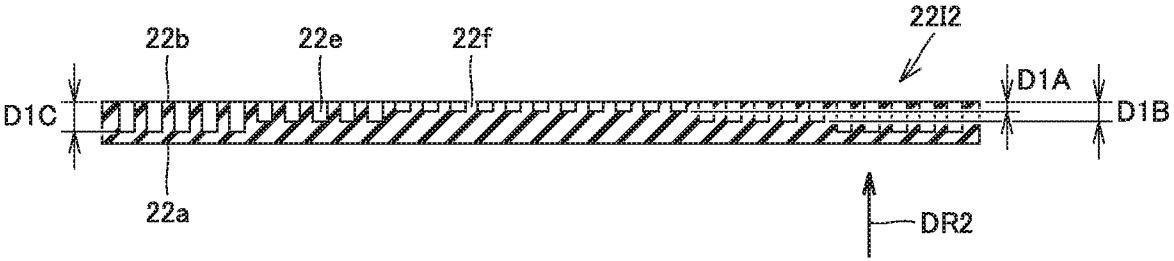

FIG. 20A is a rear view of a pressure pad according to Configuration Example 8, and FIGS. 20B and 20C are sectional views of the pressure pad according to Configuration Example 8. FIG. 21A is a rear view of a pressure pad according to a modification of Configuration Example 8, and FIGS. 21B and 21C are sectional views of the pressure pad according to the modification of Configuration Example 8. Pressure pads 22I1 and 22I2 according to Configuration Example 8 and the modification thereof will now be described with reference to FIGS. 20A to 20C and 21A to 21C. In place of pressure pad 22A of fixing device 8 according to Embodiment 1 described above, pressure pads 22I1 and 22I2 according to Configuration Example 8 and the modification thereof are included in fixing device 8.

FIGS. 20B and 20C show cross-sections taken along line XXB-XXB and line XXC-XXC shown in FIG. 20A, respectively, and FIGS. 21B and 21C show cross-sections taken along line XXIB-XXIB and line XXIC-XXIC shown in FIG. 21A, respectively.

Unlike pressure pad 22A according to Embodiment 1 described above, both of pressure pads 22I1 and 22I2 according to Configuration Example 8 and the modification thereof shown in FIGS. 20A to 20C and 21A to 21C are obtained by providing substantially uneven depths to recesses 22*e* while providing substantially uneven depths to recesses 22*e* and lattice-shaped projections 22*f* in second main surface 22*b*, thereby providing changes in the pressure applied to sheet S at nip portion N in the width direction of fixing belt 21 (i.e., the width direction of pressure pads 22I1 and 22I2).

That is to say, pressure pad 22I1 according to Configuration Example 8 shown in FIGS. 20A to 20C is configured such that a depth D1C of each of recesses 22*e* provided in the portions of second main surface 22*b* which correspond to the pair of outer regions R2 located outside in the width direction of sheet passing region R1 provided at nip portion N is smaller than a depth D1B of each of recesses 22*e* provided in the portions of second main surface 22*b* which correspond to the opposite ends in the width direction of sheet passing region R1 provided at nip portion N, and that depth D1B of each of recesses 22*e* provided in the portions of second main surface 22*b* which correspond to the opposite ends in the width direction of sheet passing region R1 provided at nip portion N is smaller than a depth D1A of each of recesses 22*e* provided in the portion of second main surface 22*b* which corresponds to the central portion in the width direction of sheet passing region R1 provided at nip portion N.

Pressure pad 22I2 according to the modification of Configuration Example 8 shown in FIGS. 21A to 21C is configured such that depth D1A of each of recesses 22*e* provided in the portion of second main surface 22*b* which corresponds to the central portion in the width direction of sheet passing region R1 provided at nip portion N is smaller than depth D1B of each of recesses 22*e* provided in the portions of second main surface 22*b* which correspond to the opposite ends in the width direction of sheet passing region R1 provided at nip portion N, and that depth D1B of each of recesses 22*e* provided in the portions of second main surface 22*b* which correspond to the opposite ends in the width direction of sheet passing region R1 provided at nip portion N is smaller than depth D1C of each of recesses 22*e* provided in the portions of second main surface 22*b* which correspond to the pair of outer regions R2 located outside in the width direction of sheet passing region R1 provided at nip portion N.

When these configurations are adopted, the pressure applied to pressure pads 22I1 and 22I2 and nip member 23 can be distributed while providing changes in the pressure applied to sheet S at nip portion N in the width direction of fixing belt 21. Similarly to pressure pads 22I1 and 22I2 according to Configuration Example 8 and the modification thereof, thus, by varying the depths of recesses 22*e* in accordance with the position on second main surface 22*b*, pressure can be applied to sheet S without any variations almost as intended in the entire region of nip portion N while appropriately controlling the pressure distribution at nip portion N in the width direction of fixing belt 21.

Particularly in the case of pressure pad 22I1 according to Configuration Example 8 described above, fixing belt 21 is nipped at a pressure, which is higher than a pressure at the central portion in the width direction of nip portion N, at opposite ends in the width direction of nip portion N, and pressure roller 10 and pressure pad 22I1 are pressed at a higher pressing force in the pair of outer regions R2 located at the outer sides in the width direction of nip portion N. This can suppress occurrence of slippage in fixing belt 21, causing driving fixing belt 21 to rotate following the rotation of pressure roller 10 more reliably. Consequently, sheet S can be transported reliably.

Such a configuration can thus suppress occurrence of poor transportation of sheet S, preventing occurrence of a malfunction such as uneven fixing due to, for example, jamming of sheet S, wrinkling of sheet S, or local overheating of sheet S.

Configuration Example 9

Figure 22B:
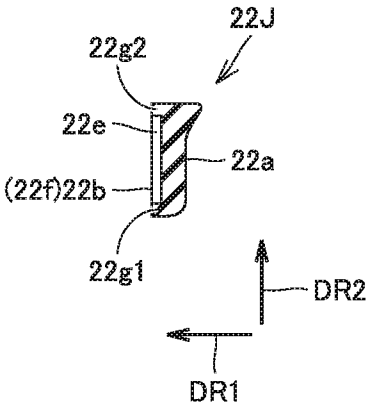
FIGS. 22B and 22C are sectional views of a pressure pad according to Configuration Example 9.
Figure 22A:
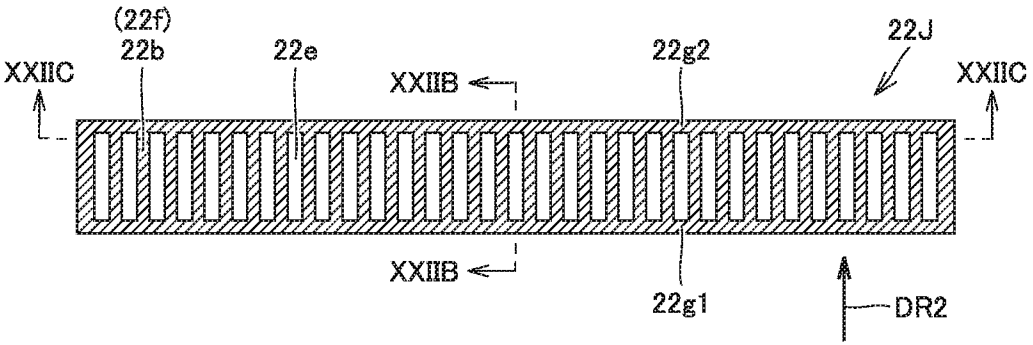
FIG. 22A is a rear view of a pressure pad according to Configuration Example 9.
Figure 22C:
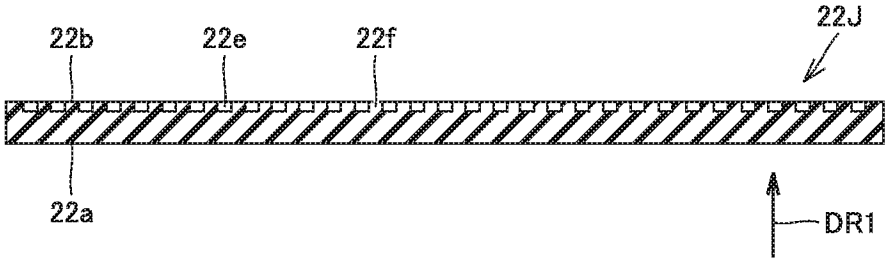

FIG. 22A is a rear view of a pressure pad according to Configuration Example 9, and FIGS. 22B and 22C are sectional views of the pressure pad according to Configuration Example 9. A pressure pad 22J according to Configuration Example 9 will now be described with reference to FIGS. 22A to 22C. In place of pressure pad 22A of fixing device 8 according to Embodiment 1 described above, pressure pad 22J according to Configuration Example 9 is included in fixing device 8. FIGS. 22B and 22C show cross-sections taken along line XXIIB-XXIIB and line XXIIC-XXIIC of FIG. 22A, respectively.

As shown in FIGS. 22A to 22C, in pressure pad 22J according to Configuration Example 9, each of recesses 22*e* is formed in a longitudinally elongated rectangular shape in plan view, and recesses 22*e* having an elongated rectangular shape in plan view are disposed to be arranged in the width direction of pressure pad 22A (i.e., the width direction of fixing belt 21). As a result, projections 22*f* are shaped into a ladder in plan view.

Second main surface 22*b* of pressure pad 22J is accordingly defined by the top surfaces of ladder-shaped projections 22*f*, and in the pressed state in which pressure pad 22J is pressed by pressure roller 10, the top surfaces of the ladder-shaped projections 22*f* are in close contact with receiving portion 23*a* of nip member 23.

Such a configuration allows recesses 22*e* and ladder-shaped projections 22*f* to be provided substantially evenly in second main surface 22*b* of pressure pad 22J. Consequently, in the pressed state in which pressure pad 22J is pressed by pressure roller 10, the pressure applied to pressure pad 22J and receiving portion 23*a* of nip member 23 can be distributed while ensuring a contact area therebetween.

Also such a configuration can thus achieve effects similar to those described in Embodiment 1, avoiding pressure distribution in which the stress applied to sheet S locally increases. This can suppress occurrence of uneven fixing in an image formed on sheet S.

Configuration Example 10

Figure 23B:
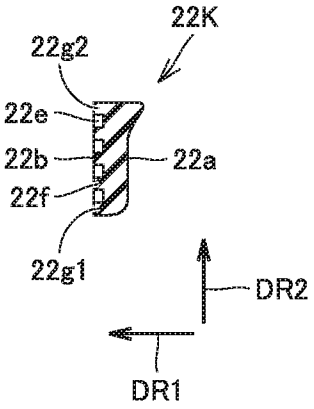
FIGS. 23B and 23C are sectional views of the pressure pad according to Configuration Example 10.
Figure 23A:
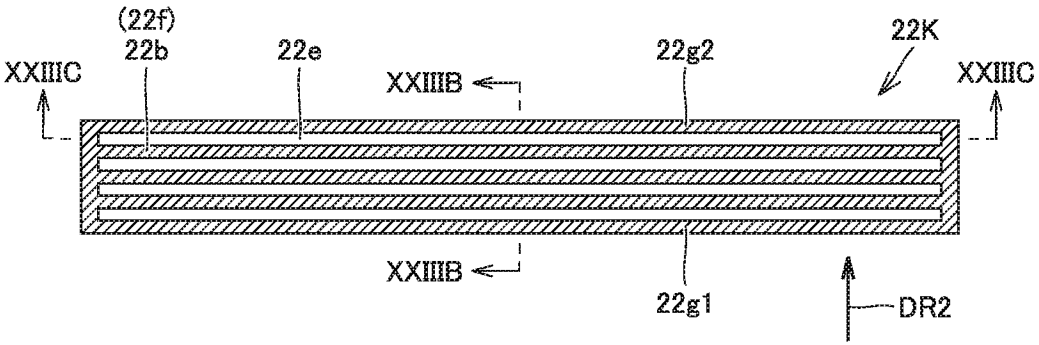
FIG. 23A is a rear view of a pressure pad according to Configuration Example 10.
Figure 23C:
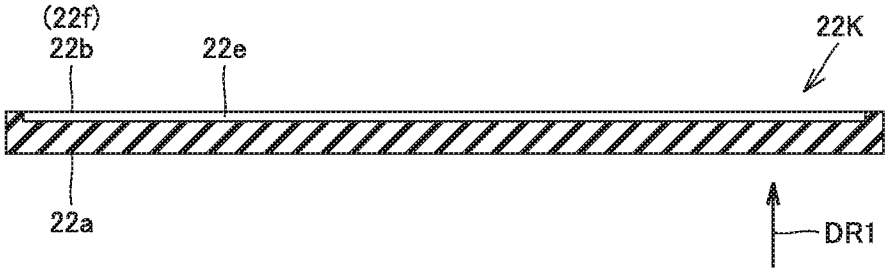

FIG. 23A is a rear view of a pressure pad according to Configuration Example 10, and FIGS. 23B and 23C are sectional views of the pressure pad according to Configuration Example 10. A pressure pad 22K according to Configuration Example 10 will now be described with reference to FIGS. 23A to 23C. In place of pressure pad 22A of fixing device 8 according to Embodiment 1 described above, pressure pad 22K according to Configuration Example 10 is included in fixing device 8. FIGS. 23B and 23C show cross-sections taken along line XXIIIB-XXIIIB and line XXIIIC-XXIIIC shown in FIG. 23A, respectively.

As shown in FIGS. 23A to 23C, in pressure pad 22K according to Configuration Example 10, each of recesses 22*e* is formed in a longitudinally elongated rectangular shape in plan view, and recesses 22*e* having an elongated rectangular shape in plan view are disposed to be arranged in direction of transport DR2 of sheet S. As a result, projections 22*f* are formed in a ladder shape in plan view.

Second main surface 22*b* of pressure pad 22K is thus defined by the top surfaces of ladder-shaped projections 22*f*, and in the pressed state in which pressure pad 22K is pressed by pressure roller 10, the top surfaces of ladder-shaped projections 22*f* are in close contact with receiving portion 23*a* of nip member 23.

Such a configuration provides recesses 22*e* and ladder-shaped projections 22*f* substantially evenly in second main surface 22*b* of pressure pad 22K. Consequently, in the pressed state in which pressure pad 22K is pressed by pressure roller 10, a pressure applied to pressure pad 22K and receiving portion 23*a* of nip member 23 can be distributed while ensuring a contact area therebetween.

Also such a configuration can thus achieve effects similar to those described in Embodiment 1, avoiding occurrence of pressure distribution in which the stress applied to sheet S locally increases. This can suppress occurrence of uneven fixing in an image formed on sheet S.

Configuration Examples 11 to 13

Figure 24A:
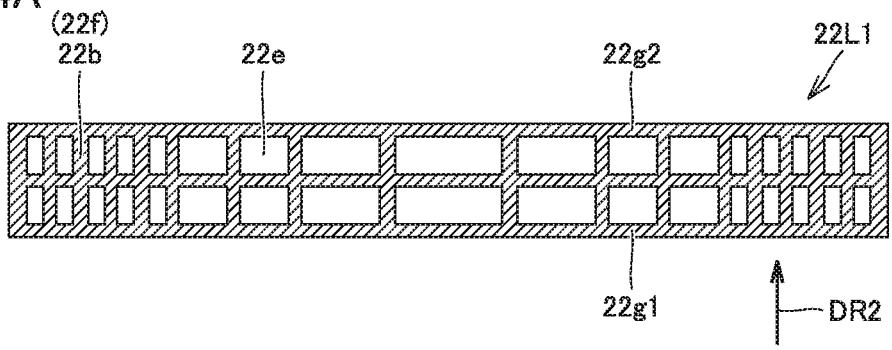
FIG. 24A is a rear view of a pressure pad according to Configuration Example 11.
Figure 24B:
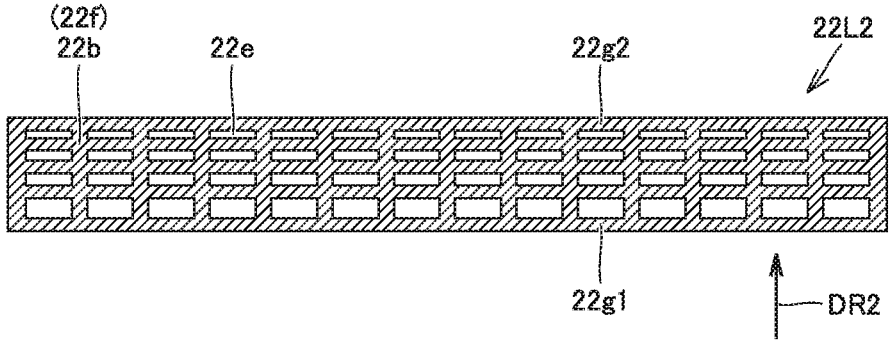
FIG. 24B is a rear view of a pressure pad according to Configuration Example 12.
Figure 24C:
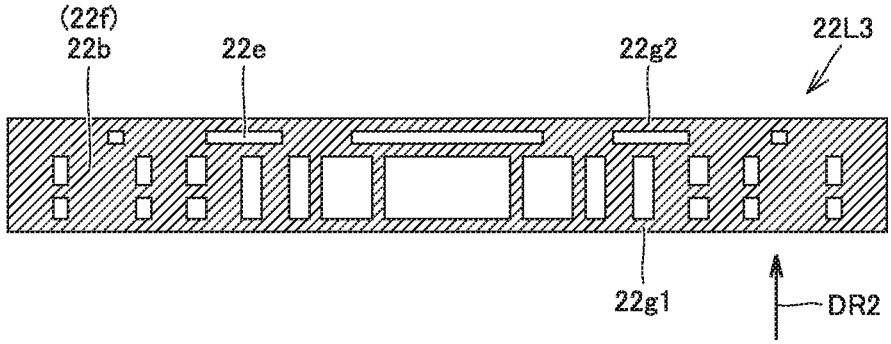
FIG. 24C is a rear view of a pressure pad according to Configuration Example 13.

FIGS. 24A to 24C are rear views of pressure pads according to Configuration Examples 11 to 13. Pressure pads 22L1 to 22L3 according to Configuration Examples 11 to 13 will now be described with reference to FIGS. 24A to 24C. In place of pressure pad 22A of fixing device 8 according to Embodiment 1, pressure pads 22L1 to 22L3 according to Configuration Examples 11 to 13 are included in fixing device 8.

Pressure pad 22L1 according to Configuration Example 11 shown in FIG. 24A is configured such that the interval between projections 22*f* arranged in the width direction of pressure pad 22L1 and the interval between projections 22*f* arranged in direction of transport DR2 of sheet S are greater than those of pressure pad 22A according to Embodiment 1 described above. Consequently, recesses 22*e* and lattice-shaped projections 22*f* are provided substantially unevenly in second main surface 22*b* while increasing the volumes of recesses 22*e*, thereby providing changes in the pressure applied to sheet S at nip portion N in the width direction of pressure pad 22L1.

Such a configuration can appropriately control the pressure distribution at nip portion N in the width direction of fixing belt 21 while reducing the thermal capacity further compared with pressure pad 22A according to Embodiment 1 described above, more reliably suppressing occurrence of poor transportation of sheet S.

Pressure pad 22L2 according to Configuration Example 12 shown in FIG. 24B is configured such that the interval between projections 22*f* arranged in the width direction of pressure pad 22L2 and the interval between projections 22*f* arranged in direction of transport DR2 of sheet S are greater than those of pressure pad 22A according to Embodiment 1 described above. Consequently, recesses 22*e* and lattice-shaped projections 22*f* are provided substantially unevenly in second main surface 22*b* while increasing the volumes of recesses 22*e*, thereby providing changes in the pressure applied to sheet S at nip portion N in width direction DR2 of pressure pad 22L1.

Such a configuration can appropriately control the pressure distribution at nip portion N in direction of transport DR of sheet S while reducing the thermal capacity further compared with pressure pad 22A according to Embodiment 1 described above, more reliably achieving a high quality image free from unevenness.

Pressure pad 22L3 according to Configuration Example 13 shown in FIG. 24C is obtained by varying the widths of projections 22*f* extending in direction of transport DR2 of sheet S, the widths of projections 22*f* extending in the width direction of pressure pad 22L3, the intervals between projections 22*f* arranged in the width direction of pressure pad 22L3, the intervals between projections 22*f* arranged in direction of transport DR2 of sheet S, and the like in accordance with the position on second main surface 22*b* to appropriately control the pressure distribution at nip portion N in direction of transport DR2 of sheet S while appropriately controlling the pressure distribution at nip portion N in the width direction of fixing belt 21.

Such a configuration can reduce thermal capacity and can also suppress occurrence of poor transportation of sheet S, and further can achieve a high quality image free from unevenness. Consequently, a fixing device more improved in various respects than a conventional fixing device can be achieved.

Embodiment 2

Figure 25:
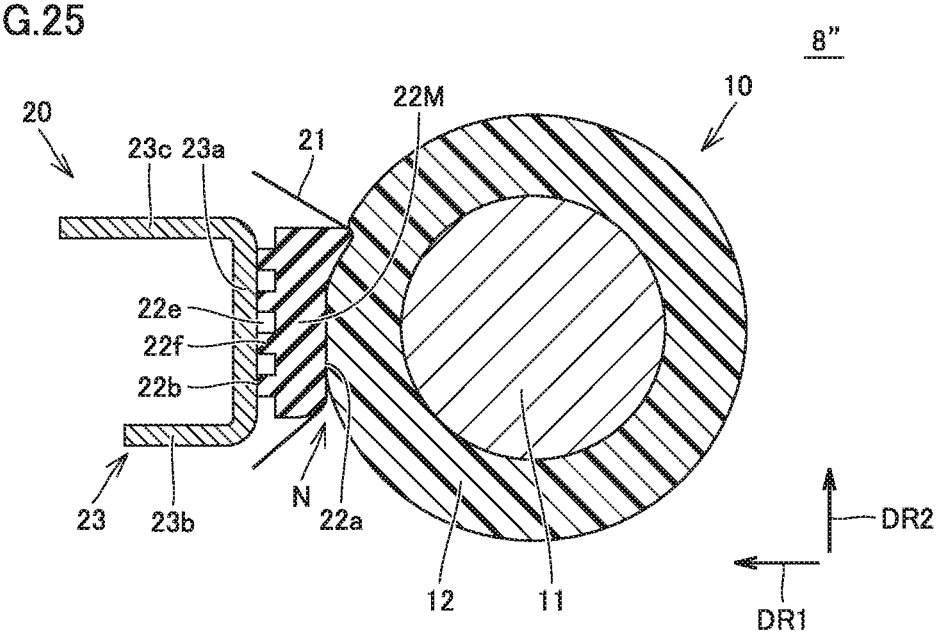
FIG. 25 is a schematic sectional view of main parts of a fixing device according to Embodiment 2 during fixing operation.
Figure 26A:
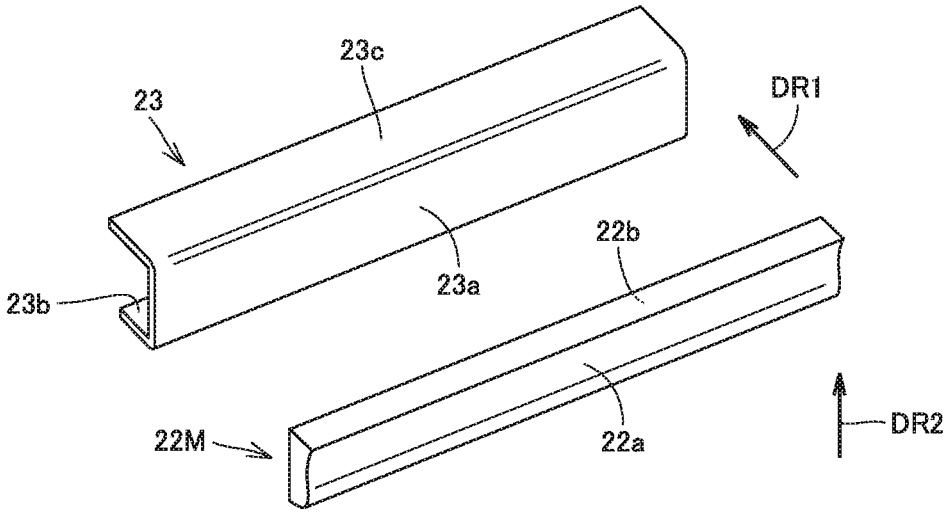
FIGS. 26A and 26B are schematic views showing the shapes of a pressure pad and a nip member of the fixing device shown in FIG. 25.
Figure 26B:
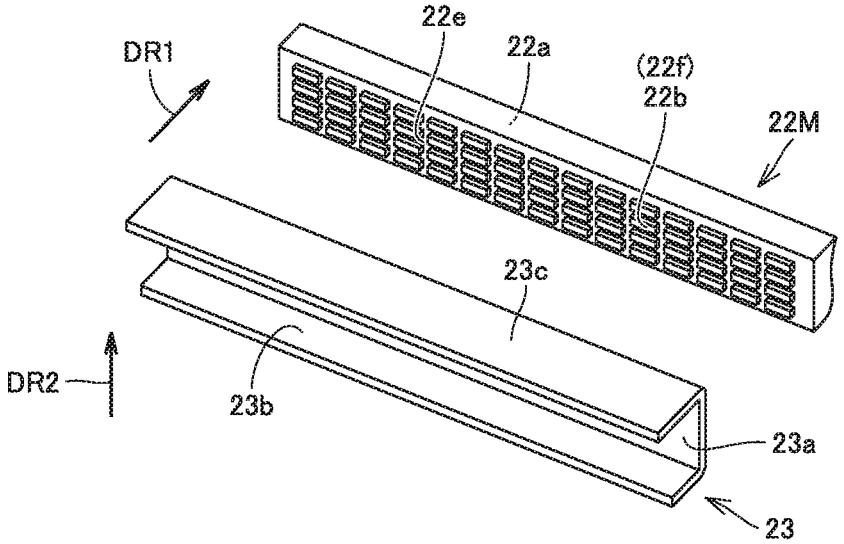
Figure 27B:
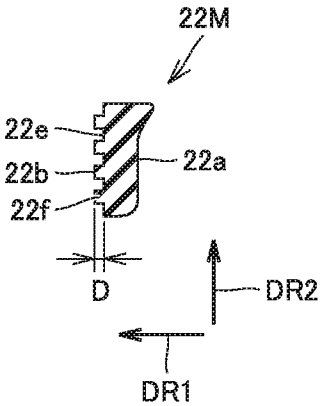
FIGS. 27B and 27C are sectional views of the pressure pad of the fixing device shown in FIG. 25.
Figure 27A:
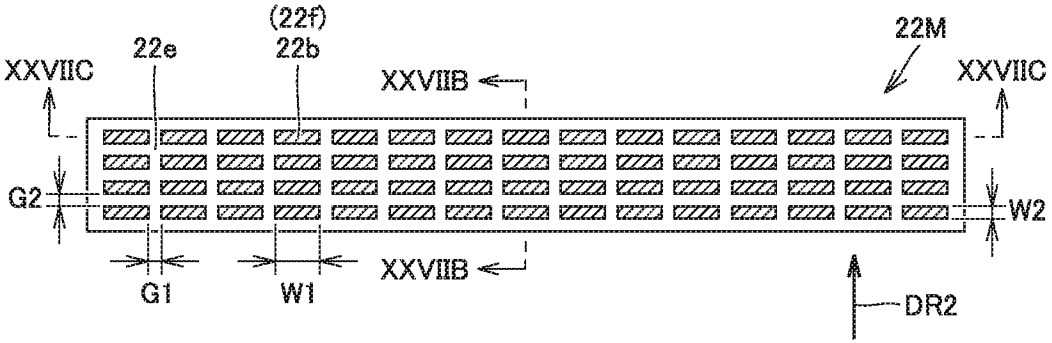
FIG. 27A is a rear view of the pressure pad of the fixing device shown in FIG. 25.
Figure 27C:
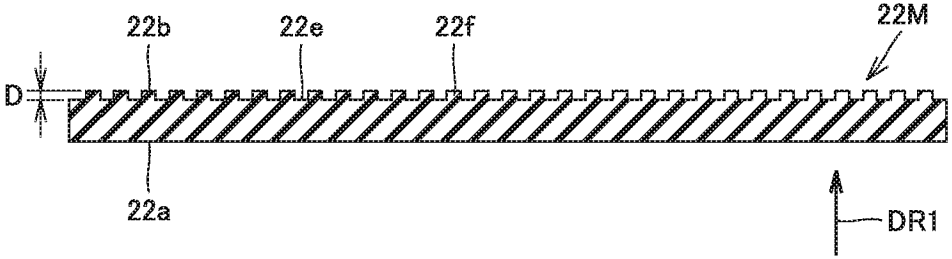

FIG. 25 is a schematic sectional view of main parts of a fixing device according to Embodiment 2 during fixing operation, and FIGS. 26A and 26B are schematic views showing the shapes of a pressure pad and a nip member of the fixing device shown in FIG. 25. FIG. 27A is a rear view of the pressure pad of the fixing device shown in FIG. 25, and FIGS. 27B and 27C are sectional views of the pressure pad of the fixing device shown in FIG. 25. A fixing device 8" according to the present embodiment will now be described with reference to FIGS. 25, 26A, 26B, and FIG. 27A to 27C.

FIG. 26A shows a pressure pad 22M and nip member 23 as viewed from the pressure roller 10 side, and FIG. 26B shows pressure pad 22M and nip member 23 as viewed from the heating roller 24 side. FIGS. 27B and 27C show cross-sections taken along line XXVIIB-XXVIIB and line XXVIIC-XXVIIC shown in FIG. 27A, respectively.

As shown in FIG. 25, fixing device 8" according to the present embodiment includes pressure roller 10 and fixing belt unit 20 similarly to fixing device 8 according to Embodiment 1 described above, and is different from fixing device 8 according to Embodiment 1 described above only in the shape of pressure pad 22M included in fixing belt unit 20.

As shown in FIGS. 25, 26A, 26B, and 27A to 27C, second main surface 22*b* of pressure pad 22M is provided with a plurality of projections 22*f*. The opposite sides of projections 22*f* are sandwiched between recesses 22*e* in the direction orthogonal to pressing direction DR1 of pressure roller 10. Herein, in the present embodiment, a pair of opposite ends of each of projections 22*f*, which are located in an extension direction in which projections 22*f* extend, and a pair of opposite ends thereof, which are located in the direction orthogonal to the extension direction, are each sandwiched between recesses 22*e*. Consequently, the entire perimeter of each of projections 22*f* is surrounded by recesses 22*e* in the direction orthogonal to pressing direction DR1 of pressure roller 10.

In the present embodiment, each of projections 22*f* is formed in a rectangular shape in plan view and is configured to be longitudinally elongated in a manner of extending in the width direction of pressure pad 22M. Projections 22*f* having a rectangular shape in plan view are disposed to be arranged in the width direction of pressure pad 22M (i.e., the width direction of fixing belt 21) and in direction of transport DR2 of sheet S, thereby being arranged in matrix. As a result, recesses 22*e* surrounding projections 22*f* are arranged in a lattice shape in plan view.

Second main surface 22*b* of pressure pad 22M is accordingly defined by the top surfaces of projections 22*f*, and in the pressed state in which pressure pad 22M is pressed by pressure roller 10, the top surfaces of projections 22*f* are in close contact with receiving portion 23*a* of nip member 23.

As shown in FIG. 27A, as viewed in pressing direction DR1, the widths of projections 22*f* extending in direction of transport DR2 of sheet S (i.e., the dimension of projection 22*f* in the width direction of pressure pad 22M) are set to an equal predetermined width W1, and the widths of projections 22*f* extending in the width direction of pressure pad 22M (i.e., the dimension of projection 22*f* in direction of transport DR2 of sheet S) are set so an equal predetermined width W2.

As viewed in pressing direction DR1, the intervals between projections 22*f* arranged in the width direction of pressure pad 22M (i.e., the width of recess 22*e* located therebetween) are set so an equal predetermined interval G1, and the intervals between projections 22*f* arranged in direction of transport DR2 of sheet S (i.e., the width of recess 22*e* located therebetween) are set to an equal predetermined interval G2.

The depths of lattice-shaped recesses 22*e* are set to an equal predetermined depth D at all positions, as shown in FIGS. 27B and 27C.

Such a configuration allows lattice-shaped recesses 22*e* and projections 22*f* to be provided substantially evenly in second main surface 22*b* of pressure pad 22M. This can distribute the pressure applied to pressure pad 22M and receiving portion 23*a* of nip member 23 while achieving a contact area therebetween in the pressed state in which pressure pad 22M is pressed by pressure roller 10.

As a result, the entire region of second main surface 22*b* of pressure pad 22M abuts against receiving portion 23*a* at an almost equal pressure, allowing pressure to be applied to sheet S without any variations almost as intended in the entire region of nip portion N. This avoids occurrence of pressure distribution in which the pressure applied to sheet S locally increases. The adoption of the above configuration can suppress occurrence of an uneven image formed on sheet S.

From the viewpoint of applying pressure to sheet S without any variations almost as intended in the entire sheet passing region R1 provided at nip portion N, it suffices that at least lattice-shaped recesses 22*e* and projections 22*f* are provided substantially evenly in the portion of second main surface 22*b* which corresponds to sheet passing region R1.

The adoption of the above configuration reduces the thermal capacity of pressure pad 22M by an amount of lattice-shaped recesses 22*e* provided. An increase in thermal capacity can be suppressed in the entire fixing device 8", contributing to reduced energy consumption.

[Modification 6]

Figure 28:
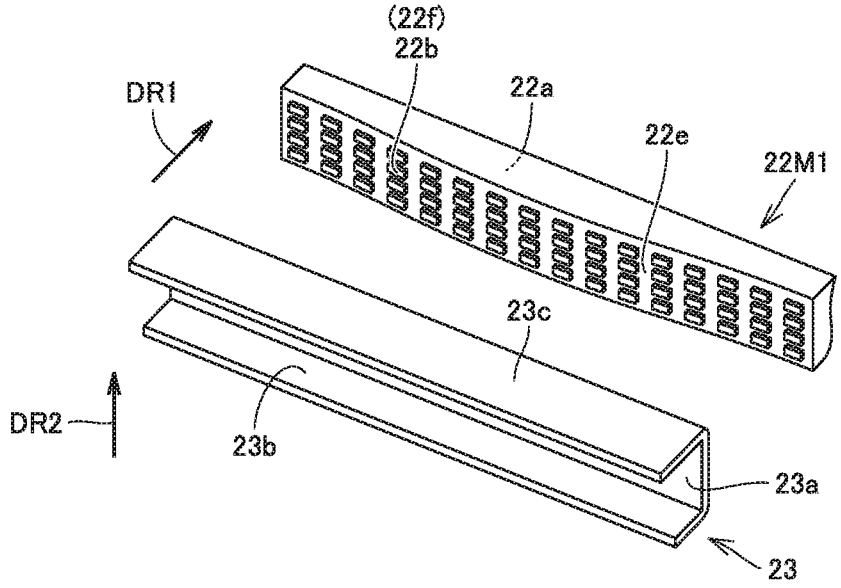
FIG. 28 is a schematic view showing the shapes of a pressure pad and a nip member of a fixing device according to Modification 6.

FIG. 28 is a schematic view showing the shapes of a pressure pad and a nip member of a fixing device according to Modification 6. The fixing device according to Modification 6 based on Embodiment 2 described above will now be described with reference to FIG. 28. FIG. 28 shows a pressure pad 22M1 and a nip member 23 as viewed from the heating roller 24 side.

As shown in FIG. 28, in the fixing device according to the present modification, with pressure pad 22M1 not being pressed by pressure roller 10, the central portion in the width direction of the portion of second main surface 22*b* which corresponds to sheet passing region R1 provided at nip portion N is shaped to bulge toward receiving portion 23*a* of nip member 23 with respect to opposite ends in the width direction of the portion of second main surface 22*b* which corresponds to sheet passing region R1 provided at nip portion N. Second main surface 22*b* of pressure pad 22M1 accordingly has a so-called normal crown shape.

In the present modification, the bulge shape described above is provided to second main surface 22*b* of pressure pad 22M1 to absorb a displacement due to bending of nip member 23 by the bulging portion, as in Modification 2 based on Embodiment 1 described above. This can suppress occurrence of bending of pressure pad 22M1 while bringing the entire region of the portion of second main surface 22*b* which corresponds to sheet passing region R1 provided at nip portion N to close contact with receiving portion 23*a*.

The adoption of the above configuration allows a pressure to be generally evenly applied to sheet S in sheet passing region R1 of nip portion N in the axial direction of pressure roller 10 (i.e., the width direction of fixing belt 21), as in Modification 2 described above. A toner image can be accordingly fixed onto the entire region in the width direction of nip portion N without causing unevenness, thereby greatly improving the quality of an image formed.

[Modifications 7 and 8]

Figure 29A:
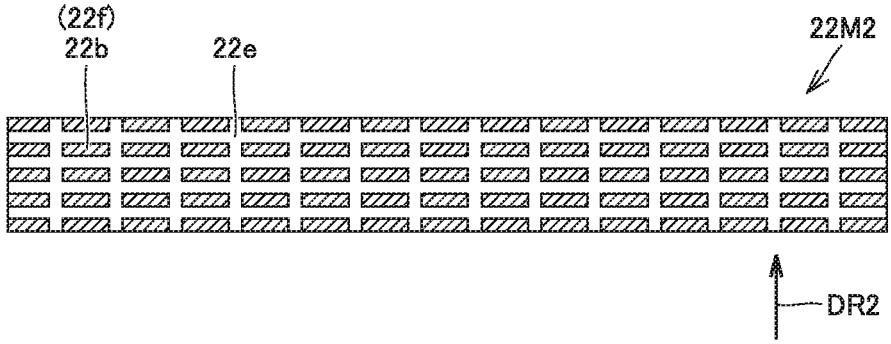
FIG. 29A is a rear view of a pressure pad of a fixing device according to Modification 7.
Figure 29B:
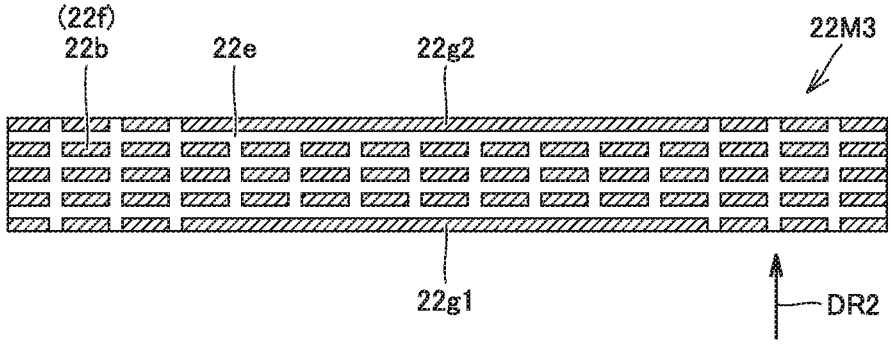
FIG. 29B is a rear view of a pressure pad of a fixing device according to Modification 8.

FIG. 29A is a rear view of a pressure pad of a fixing device according to Modification 7, and FIG. 29B is a rear view of a pressure pad of a fixing device according to Modification 8. The fixing devices according to Modifications 7 and 8 based on Embodiment 2 described above will now be described with reference to FIGS. 29A and 29B.

As shown in FIG. 29A, a pressure pad 22M2 of the fixing device according to Modification 7 is provided such that the outermost projections of projections 22*f* provided in second main surface 22*b* are each located at the edge of second main surface 22*b*. In other words, projections 22*f* are provided at the upstream edge and the downstream edge of second main surface 22*b* in direction of transport DR2 of sheet S and at a pair of edges of second main surface 22*b* in the width direction of pressure pad 22M2.

As shown in FIG. 29B, in comparison with pressure pad 22M2 according to Modification 7 described above, a pressure pad 22M3 of the fixing device according to Modification 8 is configured such that an upstream elongated protrusion 22*g*1 and a downstream elongated protrusion 22*g*2 extending in the width direction of pressure pad 22M3 are provided at a pair of edges of second main surface 22*b* which correspond to the upstream and downstream positions in direction of transport DR2 of sheet S. Herein, upstream elongated protrusion 22*g*1 and downstream elongated protrusion 22*g*2 reach the opposite ends in the width direction of the portion corresponding to the sheet passing region R1 provided at nip portion N.

Also when any of these configurations is adopted, the effects similar to those described in Embodiment 2 can be achieved, allowing application of pressure to sheet S without any variations almost as intended in the entire region of nip portion N. This can suppress an uneven image formed on sheet S.

Particularly in the case of pressure pad 22M3 according to Modification 8 described above, pressure can be applied appropriately in a stable manner to sheet S supplied to nip portion N at the entrance portion and the exit portion of nip portion N, which effectively suppresses occurrence of an uneven image formed.

Configuration Example 14 and Modification Thereof

Figure 30A:
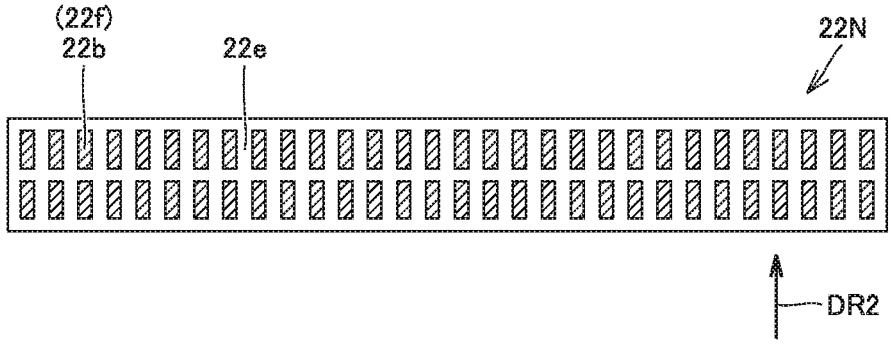
FIG. 30A is a rear view of a pressure pad according to Configuration Example 14.
Figure 30B:
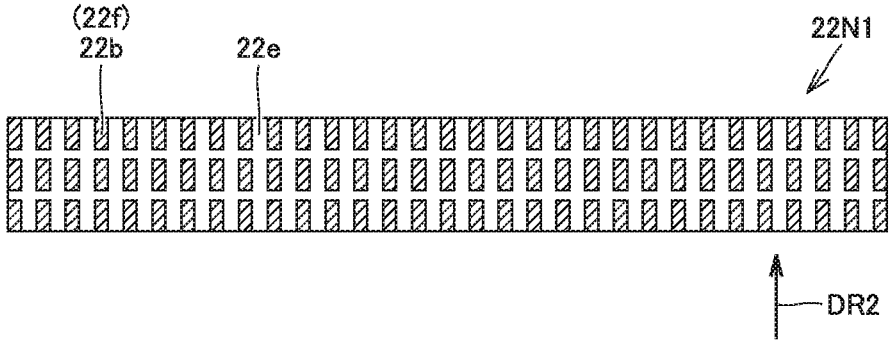
FIG. 30B is a rear view of a pressure pad according to a modification of Configuration Example 14.
Figure 30C:
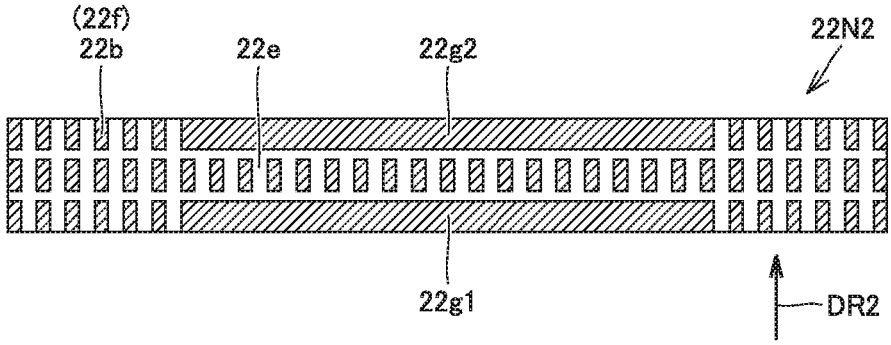
FIG. 30C is a rear view of a pressure pad according to another modification of Configuration Example 14.

FIG. 30A is a rear view of a pressure pad according to Configuration Example 14, FIG. 30B is a rear view of a pressure pad according to a modification of Configuration Example 14, and FIG. 30C is a rear view of a pressure pad according to another modification of Configuration Example 14. Pressure pads 22N, 22N1, and 22N2 according to Configuration Example 14 and the modifications thereof will now be described with reference to FIGS. 30A to 30C. In place of pressure pad 22M of fixing device 8" according to Embodiment 2 described above, pressure pads 22N, 22N1, and 22N2 according to Configuration Example 14 and the modifications thereof are included in fixing device 8".

Pressure pad 22N according to Configuration Example 14 shown in FIG. 30A is configured to be longitudinally elongated such that each of projections 22*f* formed in a rectangular shape in plan view extends in direction of transport DR2 of sheet S, unlike pressure pad 22M included in fixing device 8" according to Embodiment 2 described above. Projections 22*f* are arranged in matrix on second main surface 22*b*, and recesses 22*e* surrounding projections 22*f* are accordingly arranged in a lattice shape in plan view.

As shown in FIG. 30B, in comparison with pressure pad 22N according to Configuration Example 14 described above, pressure pad 22N1 according to the modification of Configuration Example 14 is configured such that the outermost projections of projections 22*f* provided in second main surface 22*b* are provided to be located at the edges of second main surface 22*b*. In other words, projections 22*f* are provided at the upstream edge and the downstream edge of second main surface 22*b* in direction of transport DR2 of sheet S and at a pair of edges of second main surface 22*b* in the width direction of pressure pad 22N1.

As shown in FIG. 30C, in comparison with pressure pad 22N1 according to the modification of Configuration Example 14 described above, pressure pad 22N2 according to the other modification of Configuration Example 14 is configured such that upstream elongated protrusion 22*g*1 and downstream elongated protrusion 22*g*2 which extend in the width direction of pressure pad 22N2 are provided at a pair of edges of second main surface 22*b* corresponding to the upstream and downstream positions in direction of transport DR2 of sheet S. Herein, upstream elongated protrusion 22*g*1 and downstream elongated protrusion 22*g*2 reach the opposite ends of the portion corresponding to sheet passing region R1 provided at nip portion N.

Also when any of these configurations is adopted, the effects similar to those described in Embodiment 2 can be achieved, allowing application of pressure to sheet S without any variations almost as intended in the entire region of nip portion N. This can suppress occurrence of an uneven image formed on sheet S.

Particularly in the case of pressure pad 22N2 according to the other modification of Configuration Example 14 described above, pressure can be applied appropriately in a stable manner to sheet S supplied to nip portion N at the entrance portion and the exit portion of nip portion N, which effectively suppresses occurrence of an uneven image formed.

Configuration Examples 15 to 17

Figure 31A:
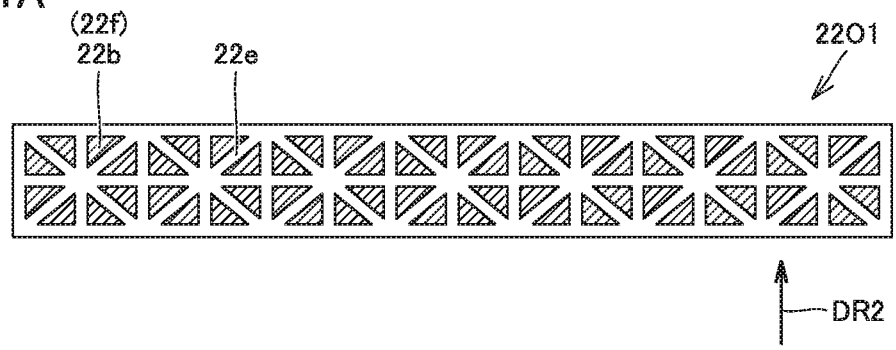
FIG. 31A is a rear view of a pressure pad according to Configuration Example 15.
Figure 31B:
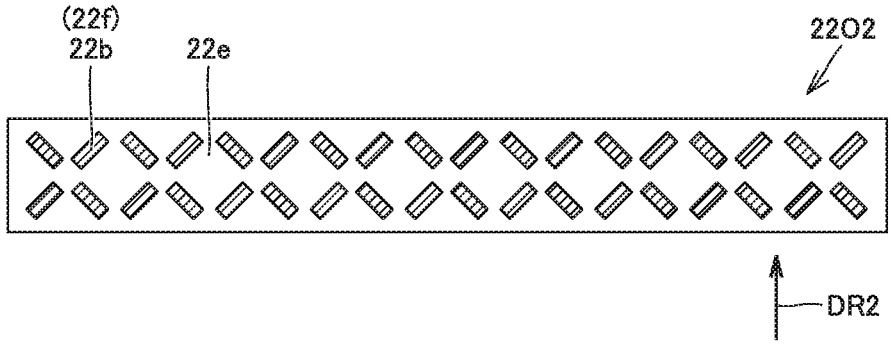
FIG. 31B is a rear view of a pressure pad according to Configuration Example 16.
Figure 31C:
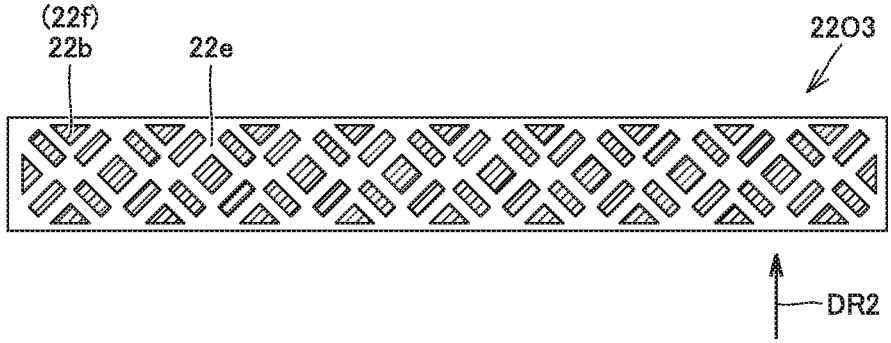
FIG. 31C is a rear view of a pressure pad according to Configuration Example 17.

FIG. 31A is a rear view of a pressure pad according to Configuration Example 15, FIG. 31B is a rear view of a pressure pad according to Configuration Example 16, and FIG. 31C is a rear view of a pressure pad according to Configuration Example 17. Pressure pads 22O1 to 22O3 according to Configuration Examples 15 to 17 will now be described with reference to FIGS. 31A to 31C. In place of pressure pad 22M of fixing device 8" according to Embodiment 2 described above, pressure pads 22O1 to 22O3 according to Configuration Examples 15 to 17 are included in fixing device 8".

Pressure pads 22O1 and 22O2 according to Configuration Examples 15 to 17 are configured such that the entire regions of second main surfaces 22*b* of pressure pads 22O1 to 22O3 abut against receiving portion 23*a* of nip member 23 at a substantially equal pressure, similarly to pressure pad 22M according to Embodiment 2 described above.

That is to say, pressure pad 22O1 according to Configuration Example 15 shown in FIG. 31A is configured as follows: truss-shaped recesses 22*e* are provided in second main surface 22*b* of pressure pad 22O1 such that the top surfaces of projections 22*f* having a triangular shape in plan view form second main surface 22*b*.

Pressure pad 22O2 according to Configuration Example 16 shown in FIG. 31B is configured as follows: recesses 22*e* having a predetermined shape are provided in second main surface 22*b* such that second main surface 22*b* of pressure pad 22O2 is defined by the top surfaces of projections 22*f* having a rectangular shape in plan view, which are arranged in accordance with a predetermined rule to extend obliquely.

Pressure pad 22O3 according to Configuration Example 17 shown in FIG. 31C is configured as follows: recesses 22*e* having a predetermined shape are provided in second main surface 22*b* such that second main surface 22*b* of pressure pad 22O3 is defined by the top surfaces of projections 22*f* having an elongated rectangular shape in plan view, a square shape in plan view, a triangular shape in plan view, and any other shape which are arranged in the predetermined rule.

Also when any of these configurations is adopted, effects similar to those described in Embodiment 2 can be achieved, allowing application of pressure to sheet S without any variations almost as intended in the entire region of nip portion N. This can suppress occurrence of an uneven image formed on sheet S.

Configuration Examples 18 and 19

Figure 32A:
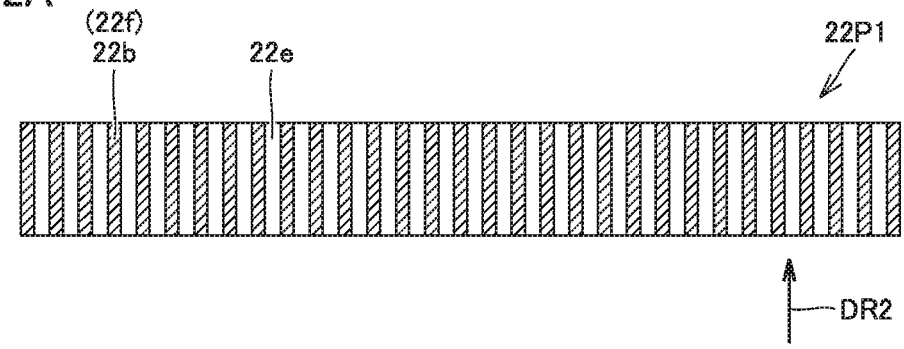
FIG. 32A is a rear view of a pressure pad according to Configuration Example 18.
Figure 32B:
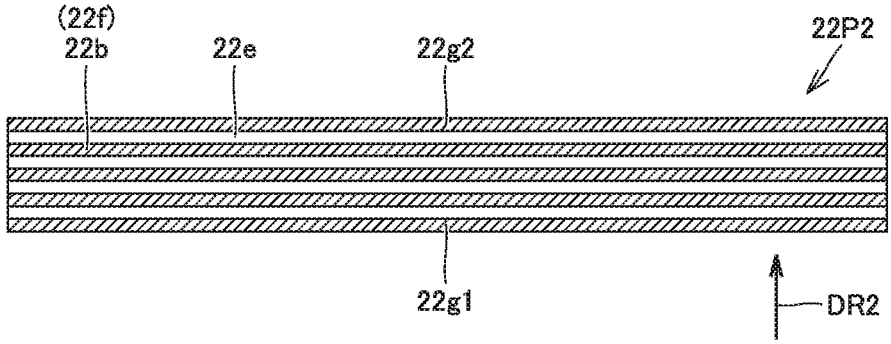
FIG. 32B is a rear view of a pressure pad according to Configuration Example 19.

FIG. 32A is a rear view of a pressure pad according to Configuration Example 18, and FIG. 32B is a rear view of a pressure pad according to Configuration Example 19. Pressure pads 22P1 and 22P2 according to Configuration Examples 18 and 19 will now be described with reference to FIGS. 32A and 32B. In place of pressure pad 22M of fixing device 8" according to Embodiment 2 described above, pressure pads 22P1 and 22P2 according to Configuration Examples 18 and 19 are included in fixing device 8".

Similarly to pressure pad 22M according to Embodiment 2 described above, pressure pads 22P1 and 22P2 according to Configuration Examples 18 and 19 are configured such that the entire second main surfaces 22*b* of pressure pads 22P1 and 22P2 abut against receiving portion 23*a* of nip member 23 at an almost equal pressure.

That is to say, pressure pad 22P1 according to Configuration Example 18 shown in FIG. 32A is configured as follows: recesses 22*e* having a vertical stripe shape are provided in second main surface 22*b* such that second main surface 22*b* of pressure pad 22P1 is defined by the top surfaces of projections 22*f* having a vertical stripe shape.

Pressure pad 22P2 according to Configuration Example 19 shown in FIG. 32B is configured as follows: recesses 22*e* having a horizontal stripe shape are provided in second main surface 22*b* such that second main surface 22*b* of pressure pad 22P2 is defined by the top surfaces of projections 22*f* having a horizontal stripe shape.

Also when any of these configurations is adopted, effects similar to those described in Embodiment 2 can be achieved, allowing application of pressure to sheet S without any variations almost as intended in the entire region of nip portion N. This can suppress occurrence of an uneven image formed on sheet S.

[Others]

Needless to say, the shapes, sizes, numbers, positions for formation, and the like of the recesses and the projections described in Embodiments 1 and 2, Configuration Examples 1 to 19, and the modifications thereof can be changed within the scope of the present invention.

Needless to say, the characteristic configurations illustrated in connection with Embodiments 1 and 2, Configuration Examples 1 to 19, and the modifications thereof can be combined with each other within the scope of the present invention.

Although the case in which the present invention is applied to a so-called tandem-type color printer based on electrophotography and a fixing device included in the color printer has been described by way of example in Embodiments 1 and 2, Configuration Examples 1 to 19, and the modifications thereof, the present invention is not limited thereto. The present invention is applicable to various types of image forming apparatuses based on electrophotography and fixing devices included in these image forming apparatuses.

Although embodiments of the present invention have been described and illustrated in detail, it is clearly understood that the same is by way of illustration and example only and not limitation, the scope of the present invention should be interpreted by terms of the appended claims

What is claimed is:

1. A fixing device that heats and pressurizes a toner image, which is formed on a recording material, at a nip portion provided in a transport path for the recording material to fix the toner image onto the recording material, the fixing device comprising:

a heating source for heating a toner image formed on the recording material;

a pressure roller and a pressure pad disposed to face each other with the transport path therebetween so as to form the nip portion; and a nip member disposed opposite to the pressure roller as viewed from the pressure pad for nipping the pressure pad between the pressure roller and the nip member in a pressed state in which the pressure pad is pressed by the pressure roller, wherein the pressure pad is formed of an elongated flat-plate member extending in a width direction parallel to an axial direction of the pressure roller and includes a first main surface located on a pressure roller side and a second main surface located on a nip member side, the nip member includes a receiving portion abutting against the pressure pad in the pressed state, a portion of the second main surface which corresponds to a passage region for the recording material provided at the nip portion is provided with a plurality of recesses, an entire perimeter of each of the plurality of recesses being surrounded by projections in a direction orthogonal to a pressing direction of the pressure roller, and top surfaces of the projections are in close contact with the receiving portion in the pressed state.

2. The fixing device according to claim 1, wherein the projections have a lattice shape, a ladder shape, or a truss shape as a whole as viewed in the pressing direction.

3. The fixing device according to claim 1, wherein widths of the plurality of projections as viewed in the pressing direction differ in accordance with a position on the second main surface.

4. The fixing device according to claim 3, wherein widths of the projections provided in a portion of the second main surface which corresponds to a downstream position in a direction of transport of the recording material are greater than widths of the projections provided in a portion of the second main surface which corresponds to an upstream position in the direction of transport of the recording material.

5. The fixing device according to claim 3, wherein widths of the projections provided at opposite ends in the width direction of the portion of the second main surface which corresponds to the passage region for the recording material provided at the nip portion are greater than widths of the projections provided at a central portion in the width direction of the portion of the second main surface which corresponds to the passage region for the recording material provided at the nip portion.

6. The fixing device according to claim 1, wherein intervals between the projections as viewed in the pressing direction differ in accordance with a position on the second main surface.

7. The fixing device according to claim 6, wherein intervals between the projections provided in a portion of the second main surface which corresponds to a downstream position in a direction of transport of the recording material are smaller than intervals between the projections provided in a portion of the second main surface which corresponds to an upstream position in the direction of transport of the recording material.

8. The fixing device according to claim 6, wherein intervals between the projections provided at opposite ends in the width direction of the portion of the second main surface which corresponds to the passage region for the recording material provided at the nip portion are smaller than intervals between the projections provided at a central portion in the width direction of the portion of the second main surface which corresponds to the passage region of the recording material provided at the nip portion.

9. The fixing device according to claim 1, wherein depths of the plurality of recesses differ in accordance with a position on the second main surface.

10. The fixing device according to claim 9, wherein depths of the recesses provided in a portion of the second main surface which corresponds to a downstream position in a direction of transport of the recording material are smaller than depths of the recesses provided in a portion of the second main surface which corresponds to an upstream position in the direction of transport of the recording material.

11. The fixing device according to claim 9, wherein depths of the recesses provided at opposite ends in the width direction of the portion of the second main surface which corresponds to the passage region for the recording material provided at the nip portion are smaller than depths of the recesses provided at a central portion in the width direction of the portion of the second main surface which corresponds to the passage region for the recording material provided at the nip portion.

12. The fixing device according to claim 1, wherein an edge of the second main surface which corresponds to an upstream position in a direction of transport of the recording material is provided with an upstream elongated protrusion extending in the width direction, an edge of the second main surface which corresponds to a downstream position in the direction of transport of the recording material is provided with a downstream elongated protrusion extending in the width direction, and the upstream elongated protrusion and the downstream elongated protrusion each reach opposite ends in the width direction of the portion corresponding to the passage region for the recording material provided at the nip portion.

13. The fixing device according to claim 1, wherein the pressure pad is assembled to the nip member.

14. The fixing device according to claim 1, wherein a surface of a portion of the receiving portion which abuts against the second main surface in the pressed state has a planar shape.

15. The fixing device according to claim 1, further comprising a fixing belt being endless and surrounding the pressure pad about an axis parallel to the width direction to pass through the nip portion in a direction of transport of the recording material, wherein the fixing belt is pressed toward the pressure pad by the pressure roller in the pressed state and is heated by the heating source at a position other than the nip portion, and in the pressed state, the pressure roller is rotationally driven to cause the fixing belt to rotate following the rotation of the pressure roller while sliding on the first main surface, and in the pressed state, a toner image formed on the recording material contacts the fixing belt at the nip portion to be heated by the fixing belt heated by the heating source.

16. The fixing device according to claim 15, wherein a low-friction member for reducing a frictional resistance between the pressure pad and the fixing belt is disposed to surround the pressure pad about an axis parallel to the width direction to cover each of the first main surface and the second main surface, and a portion of the low-friction member which covers the second main surface is provided with a hole portion, and an engagement pin projecting from the second main surface toward the nip member to be inserted through the hole portion is provided in the pressure pad, thereby assembling the low-friction member to the pressure pad.

17. An image forming apparatus comprising a fixing device according to claim 1 for image formation.

18. A fixing device that heats and pressurizes a toner image, which is formed on a recording material, at a nip portion provided in a transport path for the recording material to fix the toner image onto the recording material, the fixing device comprising:

a heating source for heating a toner image formed on the recording material;

a pressure roller and a pressure pad disposed to face each other with the transport path therebetween so as to form the nip portion; and a nip member disposed opposite to the pressure roller as viewed from the pressure pad for nipping the pressure pad between the pressure roller and the nip member in a pressed state in which the pressure pad is pressed by the pressure roller, wherein the pressure pad is formed of an elongated flat-plate member extending in a width direction parallel to an axial direction of the pressure roller and includes a first main surface located on a pressure roller side and a second main surface located on a nip member side, the nip member includes a receiving portion, the receiving portion being a flat plate having a first planar side abutting against the pressure pad in the pressed state, a portion of the second main surface which corresponds to a passage region for the recording material provided at the nip portion is provided with a plurality of projections each having an elongated projection shape and being sandwiched between recesses in a direction orthogonal to a pressing direction of the pressure roller, and each of top surfaces of the plurality of projections is in close contact with the receiving portion in the pressed state.

19. The fixing device according to claim 18, wherein the recesses have a lattice shape, a ladder shape, or a truss shape as a whole as viewed in the pressing direction.

20. The fixing device according to claim 18, wherein widths of the plurality of projections as viewed in the pressing direction differ in accordance with a position on the second main surface.

21. The fixing device according to claim 20, wherein widths of the projections provided in a portion of the second main surface which corresponds to a downstream position in a direction of transport of the recording material are greater than widths of the projections provided in a portion of the second main surface which corresponds to an upstream position in the direction of transport of the recording material.

22. The fixing device according to claim 20, wherein widths of the projections provided at opposite ends in the width direction of the portion of the second main surface which corresponds to the passage region for the recording material provided at the nip portion are greater than widths of the projections provided at a central portion in the width direction of the portion of the second main surface which corresponds to the passage region for the recording material provided at the nip portion.

23. The fixing device according to claim 18, wherein intervals between the projections as viewed in the pressing direction differ in accordance with a position on the second main surface.

24. The fixing device according to claim 23, wherein intervals between the projections provided in a portion of the second main surface which corresponds to a downstream position in a direction of transport of the recording material are smaller than intervals between the projections provided in a portion of the second main surface which corresponds to an upstream position in the direction of transport of the recording material.

25. The fixing device according to claim 23, wherein intervals between the projections provided at opposite ends in the width direction of the portion of the second main surface which corresponds to the passage region for the recording material provided at the nip portion are smaller than intervals between the projections provided at a central portion in the width direction of the portion of the second main surface which corresponds to the passage region of the recording material provided at the nip portion.

26. The fixing device according to claim 18, wherein depths of the plurality of recesses differ in accordance with a position on the second main surface.

27. The fixing device according to claim 26, wherein widths of the recesses provided in a portion of the second main surface which corresponds to a downstream position in a direction of transport of the recording material are smaller than depths of the recesses provided in a portion of the second main surface which corresponds to an upstream position in the direction of transport of the recording material.

28. The fixing device according to claim 26, wherein depths of the recesses provided at opposite ends in the width direction of the portion of the second main surface which corresponds to the passage region for the recording material provided at the nip portion are smaller than depths of the recesses provided at a central portion in the width direction of the portion of the second main surface which corresponds to the passage region for the recording material provided at the nip portion.

29. The fixing device according to claim 18, wherein an edge of the second main surface which corresponds to an upstream position in a direction of transport of the recording material is provided with an upstream elongated protrusion extending in the width direction, an edge of the second main surface which corresponds to a downstream position in the direction of transport of the recording material is provided with a downstream elongated protrusion extending in the width direction, and the upstream elongated protrusion and the downstream elongated protrusion each reach opposite ends in the width direction of the portion corresponding to the passage region for the recording material provided at the nip portion.

30. The fixing device according to claim 18, wherein the pressure pad is assembled to the nip member.

31. The fixing device according to claim 18, wherein the nip member has a C-shaped cross-section including the receiving portion, which abuts against the second main surface in the pressed state, and a pair of flat-shaped wall portions provided from upstream and downstream ends of the flat plate of the receiving portion.

32. The fixing device according to claim 18, further comprising a fixing belt being endless and surrounding the pressure pad about an axis parallel to the width direction to pass through the nip portion in a direction of transport of the recording material, wherein the fixing belt is pressed toward the pressure pad by the pressure roller in the pressed state and is heated by the heating source at a position other than the nip portion, and in the pressed state, the pressure roller is rotationally driven to cause the fixing belt to rotate following the rotation of the pressure roller while sliding on the first main surface, and in the pressed state, a toner image formed on the recording material contacts the fixing belt at the nip portion to be heated by the fixing belt heated by the heating source.

33. The fixing device according to claim 32, wherein a low-friction member for reducing a frictional resistance between the pressure pad and the fixing belt is disposed to surround the pressure pad about an axis parallel to the width direction to cover each of the first main surface and the second main surface, and a portion of the low-friction member which covers the second main surface is provided with a hole portion, and an engagement pin projecting from the second main surface toward the nip member to be inserted through the hole portion is provided in the pressure pad, thereby assembling the low-friction member to the pressure pad.

34. An image forming apparatus including a fixing device according to claim 18 for image formation.

* * * * *